US012338037B2

(12) United States Patent
Ni

(10) Patent No.: US 12,338,037 B2
(45) Date of Patent: Jun. 24, 2025

(54) BEVERAGE CONTAINER WITH ROTATABLE SEALING ARRANGEMENT

(71) Applicant: Ozean International Inc, San Marino, CA (US)

(72) Inventor: Zhenming Ni, San Marino, CA (US)

( * ) Notice: Subject to any disclaimer, the term of this patent is extended or adjusted under 35 U.S.C. 154(b) by 295 days.

(21) Appl. No.: 18/051,849

(22) Filed: Nov. 1, 2022

(65) Prior Publication Data

US 2023/0079738 A1 Mar. 16, 2023

Related U.S. Application Data

(63) Continuation-in-part of application No. 17/510,323, filed on Oct. 25, 2021, now abandoned.

(30) Foreign Application Priority Data

Apr. 30, 2021 (CN) ..... 202110480771.5

(51) Int. Cl.

| | |
|---|---|
| ***B65D 43/26*** | (2006.01) |
| ***B65D 41/02*** | (2006.01) |
| ***B65D 43/02*** | (2006.01) |
| ***B65D 47/26*** | (2006.01) |
| ***B65D 53/02*** | (2006.01) |

(52) U.S. Cl.

CPC ..... *B65D 43/26* (2013.01); *B65D 41/023* (2013.01); *B65D 43/0229* (2013.01); *B65D 47/265* (2013.01); *B65D 53/02* (2013.01); *B65D 2543/00046* (2013.01); *B65D 2543/0049* (2013.01); *B65D 2543/00953* (2013.01)

(58) Field of Classification Search

CPC .. B65D 47/265; B65D 47/261; B65D 41/023; B65D 2543/00046; B65D 43/26; B65D 47/266; B65D 47/244; B65D 43/0229; B65D 2543/0049

USPC ..... 220/243–251, 314, 254.4, 714, 715

See application file for complete search history.

(56) References Cited

U.S. PATENT DOCUMENTS

| | | | | |
|---|---|---|---|---|
| 6,010,029 A * | 1/2000 | Wang | ..... | B65D 47/265 222/506 |
| 6,443,336 B2 * | 9/2002 | Antonetti | ..... | B65D 47/265 222/509 |
| 6,626,314 B1 * | 9/2003 | McHenry | ..... | B65D 47/265 220/255 |
| 10,683,147 B2 * | 6/2020 | Choltco-Devlin | ... | B65D 47/265 |

(Continued)

*Primary Examiner* — Nathan J Jenness
*Assistant Examiner* — Jennifer Castriotta
(74) *Attorney, Agent, or Firm* — Tsz Lung Yeung

(57) ABSTRACT

A beverage container includes a container body, a lid and a rotatable sealing arrangement. The lid includes a lid body having a top panel and an access opening. The rotatable sealing arrangement includes a cover assembly and a sealing piece. The cover assembly includes a main shaft and a first sealing cover extended from the main shaft and positioned on the top panel of the lid body. The sealing piece is movably coupled to the main shaft, and includes a coupler ring having a through hole and a second sealing cover extended from the coupler ring. When the cover assembly is in an opened position, the cover assembly is rotated so that the first sealing cover is rotated to cover on top of the access opening, while the second sealing cover is driven to move upwardly with respect to the main shaft for blocking the access opening.

15 Claims, 18 Drawing Sheets

(56) References Cited

U.S. PATENT DOCUMENTS

| | | | | |
|---|---|---|---|---|
| 2013/0213966 | A1* | 8/2013 | Steininger | B65D 47/265<br>220/253 |
| 2021/0354889 | A1* | 11/2021 | Wong | A47G 19/2272 |
| 2021/0403207 | A1* | 12/2021 | Li | B65D 43/0229 |
| 2022/0015560 | A1* | 1/2022 | Forsyth | B65D 47/265 |

* cited by examiner

BEVERAGE CONTAINER WITH ROTATABLE SEALING ARRANGEMENT

CROSS REFERENCES OF RELATED APPLICATION

This application is a Continuation-In-Part of a non-provisional application having an application Ser. No. of 17/510,323, and a filing date of Oct. 25, 2021, the entire specification of which is herein incorporated by reference.

BACKGROUND OF THE PRESENT INVENTION

Field of Invention

The present invention relates a beverage container, and more particularly to a beverage container comprising a rotatable sealing arrangement, in which a cover assembly and a sealing piece provides a double sealing effect to an access opening of a lid body so as to prevent liquid from spilling out of the beverage container even when it is flipped side way or turned upside down.

Description of Related Arts

A conventional container, such as a beverage container for containing water, usually comprises a container body and a lid detachably attached on the container body. The container body has a container cavity for storing a predetermined amount of fluid, such as water. The lid usually comprises a lid body having a drinking hole communicating with the container cavity, and a sealing handle movably mounted on the lid body for selectively opening or closing the drinking hole.

Conventionally, the sealing handle may be coupled to the lid body in such a manner that the sealing handle can rotate with respect to the lid body. Through rotational movement of the sealing handle, the sealing handle may be selectively rotate to open and block the drinking hole.

A major disadvantage of the conventional beverage container such as the one mentioned above is that there is no locking mechanism to restrict the rotational movement of the sealing handle. For those beverage containers which utilize similar structures, the sealing handle is tightly coupled to the lid body so that although the sealing handle may rotate with respect to the lid body, it is very hard for a user to rotate the sealing handle for opening and closing the drinking hole. This disadvantage presents great inconvenience to users especially when the beverage container is being used in outdoor environment or the users are very young (such as kids) when he or she does not have adequate power to turn the sealing handle.

Moreover, most conventional beverage containers having the sealing handle as mentioned above does not have adequate sealing so that when the beverage container is flipped side way or turned upside down, liquid in the beverage containers may spill out of the container.

Therefore, there is a need to develop a beverage container having a rotatable sealing handle which is easy to be rotated, which can be locked and unlocked with ease, and which has a superior sealing performance.

SUMMARY OF THE PRESENT INVENTION

Certain variations of the present invention provide a beverage container comprising a rotatable sealing arrangement, in which a cover assembly may be selectively rotated to selectively and securely seal a container cavity.

Certain variations of the present invention provide a beverage container comprising a rotatable sealing arrangement which prevents liquid from spilling out of the beverage container even when it is flipped side way or turned upside down.

Certain variations of the present invention provide a beverage container comprising a rotatable sealing arrangement which comprises a cover assembly and a sealing piece for providing double sealing effect to an access opening of a lid body. This effectively prevents liquid from spilling out of the beverage container even when it is flipped side way or turned upside down.

In one aspect of the present invention, it provides a beverage container, comprising:

a container body having a container cavity; and a lid, which comprises a lid body detachably attached on the container body to selectively enclose the container cavity, the lid body having a top panel, a through central opening, and an access opening formed on the top panel at a position apart from the through central opening; and a rotatable sealing arrangement, which comprises:

a cover assembly which comprises a main shaft and a first sealing cover transversely extended from the main shaft and positioned on the top panel of the lid body; and a sealing piece movably coupled to the main shaft of the cover assembly, the sealing piece comprising a coupler ring having a through hole formed therein, a second sealing cover sidewardly extended from the coupler ring to position underneath the first sealing cover and the access opening, the cover assembly being rotated on the lid body to operatively move between an opened position and a closed position, wherein in the closed position, the cover assembly is rotated so that the first sealing cover is rotated to cover on top of the access opening, while the second sealing cover of the sealing piece is driven to move upwardly with respect to the main shaft for blocking a bottom side of the access opening so as to prevent liquid from the container cavity to spill out therefrom, wherein in the opened position, the first sealing cover is rotated to expose the access opening to ambient environment, while the second sealing cover is driven to move downwardly with respect to the main shaft so as to allow liquid to flow out of the container cavity through the access opening.

In another aspect of the present invention, it provides a lid for a container body having a container cavity, the lid comprising:

a lid body having a top panel, a through central opening, and an access opening formed on the top panel at a position apart from the through central opening; and a rotatable sealing arrangement, which comprises:

a cover assembly which comprises a main shaft and a first sealing cover transversely extended from the main shaft and positioned on the top panel of the lid body; and a sealing piece movably coupled to the main shaft of the cover assembly, the sealing piece comprising a coupler ring having a through hole formed therein, a second sealing cover sidewardly extended from the coupler ring to position underneath the first sealing cover and the access opening, the cover assembly being rotated on the lid body to operatively move between an opened position and a closed position, wherein in the closed position, the cover assembly is rotated so that the first sealing cover is rotated to cover on top of the access opening, while the second sealing cover of the sealing piece is driven to move upwardly with respect to the main shaft for blocking a bottom side of the access opening so as to prevent liquid from the container cavity to spill out therefrom, wherein in the opened position, the first sealing cover is rotated to expose the access opening to ambient environment, while the second sealing cover is driven to move downwardly with respect to the main shaft so as to allow liquid to flow out of the container cavity through the access opening.

This summary presented above is provided merely to introduce certain concepts and not to identify any key or essential features of the claimed subject matter.

DETAILED DESCRIPTION OF THE PREFERRED EMBODIMENT

Figure 1:
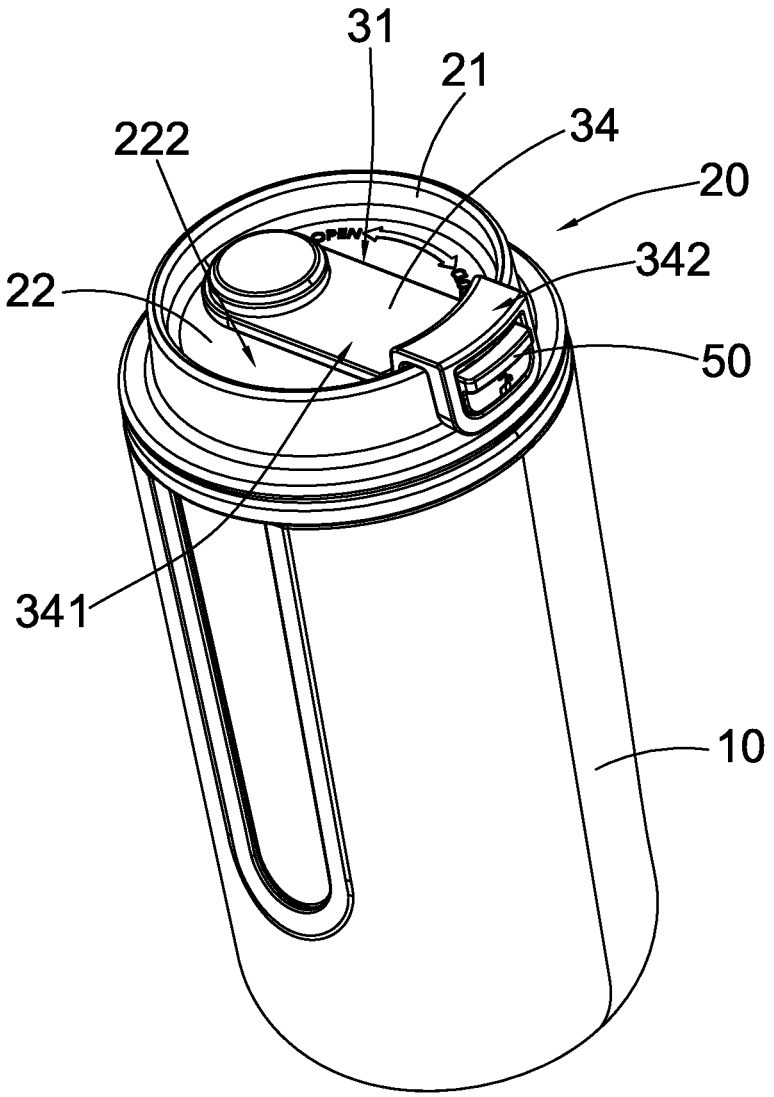
FIG. 1 is a perspective view of a beverage container according to a first preferred embodiment of the present invention.

The following detailed description of the preferred embodiment is the preferred mode of carrying out the invention. The description is not to be taken in any limiting sense. It is presented for the purpose of illustrating the general principles of the present invention.

In the following descriptions, it should also be appreciated that the terms "arrange" and "set" in the following description refer to the connecting relationship in the accompanying drawings for easy understanding of the present invention. For example, the "arrange" and "set" can refer to one element directly or indirectly set or arrange on another element. Therefore, the above terms should not be an actual connection limitation of the elements of the present invention.

It should also be appreciated that the terms "center", "length", "width", "thickness", "top", "bottom", "front", "rear", "left", "right", vertical", "horizontal", "upper", "lower", "interior", and "exterior" in the following description refer to the orientation or positioning relationship in the accompanying drawings for easy understanding of the present invention without limiting the actual location or orientation of the present invention. Therefore, the above terms should not be an actual location limitation of the elements of the present invention.

Moreover, it should be appreciated that the terms "first", "second", "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

It should be appreciated that the terms "install", "connect", "couple", and "mount" in the following description refer to the connecting relationship in the accompanying drawings for easy understanding of the present invention. For example, the connection can refer to permanent connection or detachable connection. Therefore, the above terms should not be an actual connection limitation of the elements of the present invention.

Referring to FIG. 1 to FIG. 12 of the drawings, a beverage container according to a first preferred embodiment of the present invention is illustrated. The beverage container may comprise a container body 10, a lid 20, and a rotatable sealing arrangement 30. The container body 10 may have a container cavity 11. The beverage container may be used for storing a predetermined amount of liquid, such as water, and may be carried in a portable manner.

The lid 20 may comprise a lid body 21 detachably attached on the container body 10 to selectively enclose the container cavity 11, the lid body 21 may have a top panel 22, a through central opening 23, and an access opening 24 formed on the top panel 22 at a position apart from the through central opening 23.

The rotatable sealing arrangement 30 may comprise a cover assembly 31 and a sealing piece 32. The cover assembly 31 may comprise a main shaft 33 and a first sealing cover 34 transversely extended from the main shaft 33 and positioned on the top panel 22 of the lid body 21.

The sealing piece 32 may be movably coupled to the main shaft 33 of the cover assembly 31. The sealing piece 32 may comprise a coupler ring 35 having a through hole 351 formed therein, a second sealing cover 36 sidewardly extended from the coupler ring 35 to position underneath the first sealing cover 34 and the access opening 24.

Figure 2:
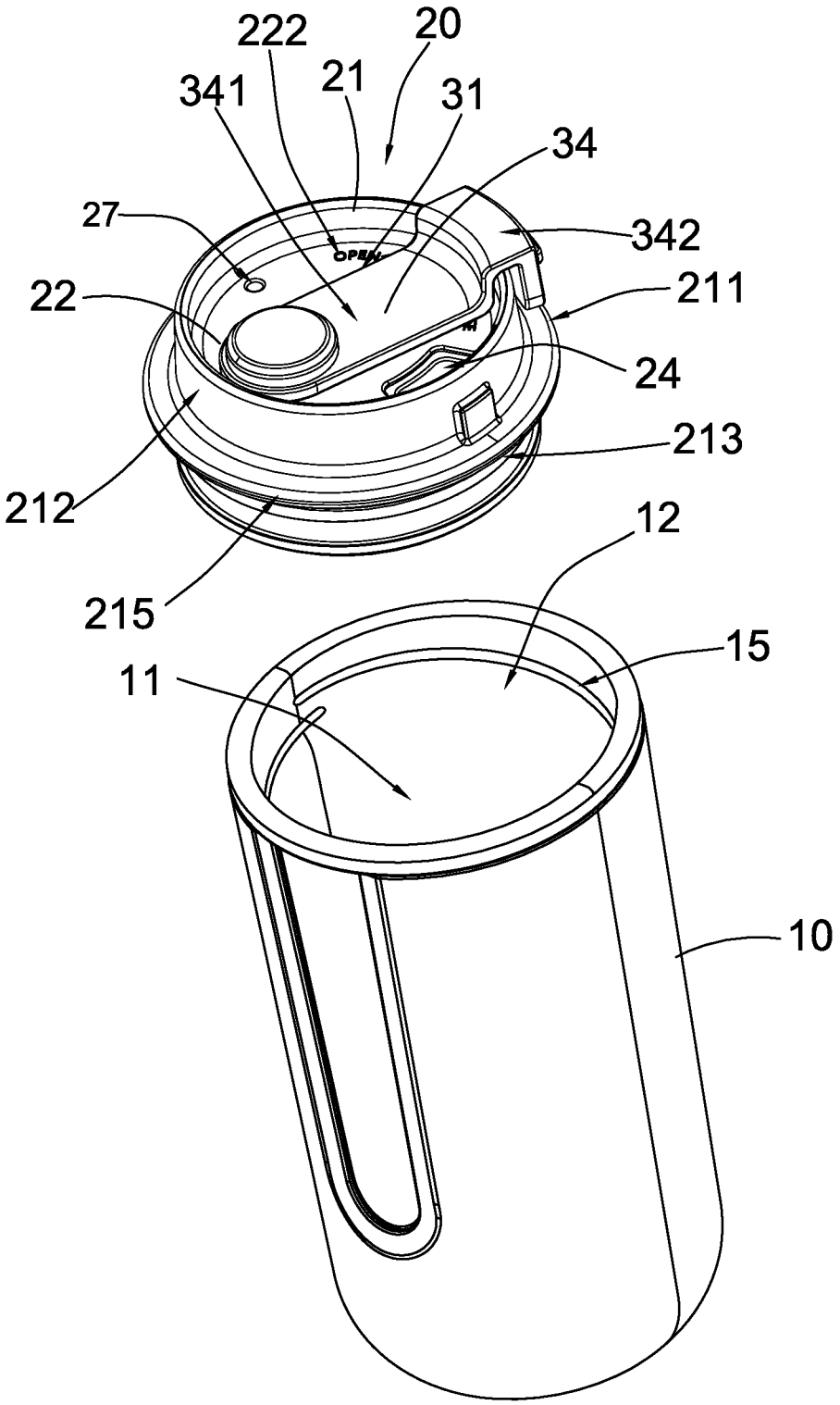
FIG. 2 is an exploded perspective view of the beverage container according to the first preferred embodiment of the present invention.
Figure 5:
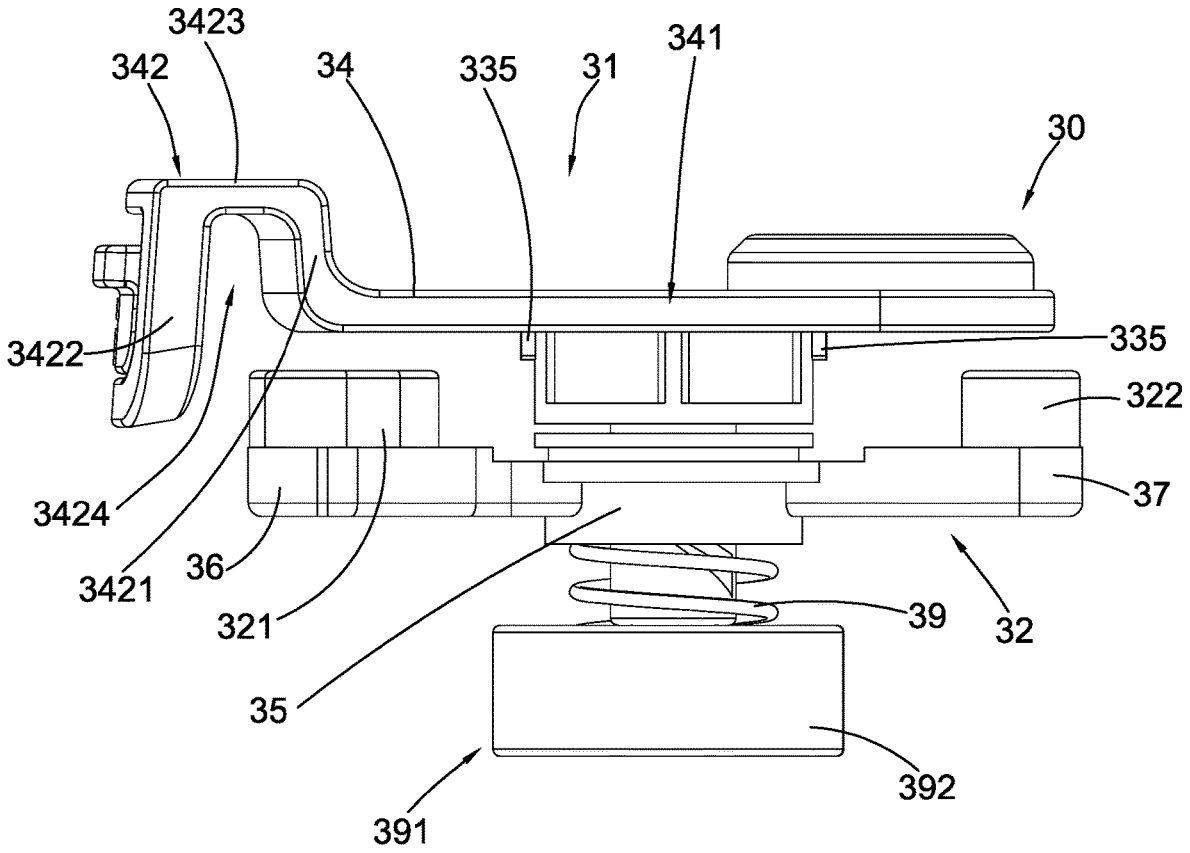
FIG. 5 is a side view of a rotatable sealing arrangement of the lid according to the first preferred embodiment of the present invention, illustrating that a cover assembly is in a closed position.
Figure 6:
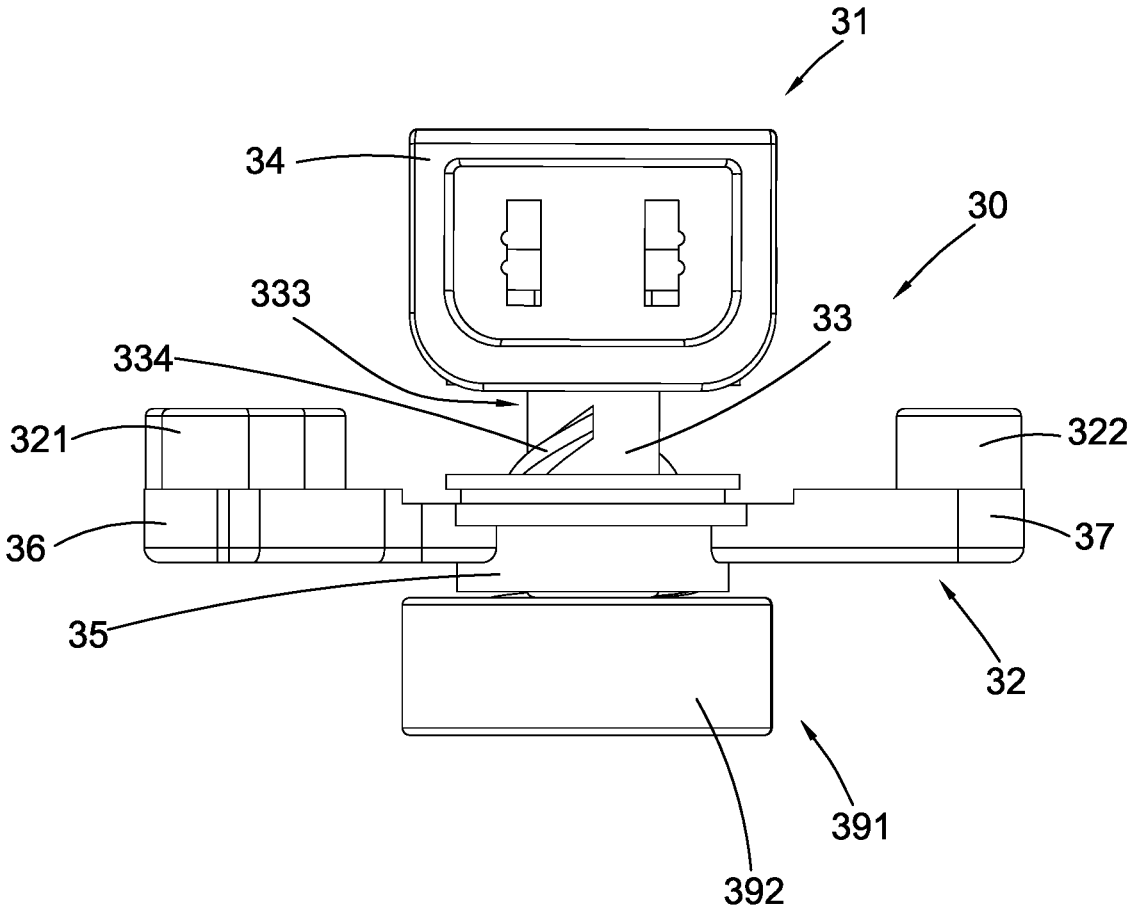
FIG. 6 is a side view of a rotatable sealing arrangement of the lid according to the first preferred embodiment of the present invention, illustrating that a cover assembly is in an opened position.
Figure 7:
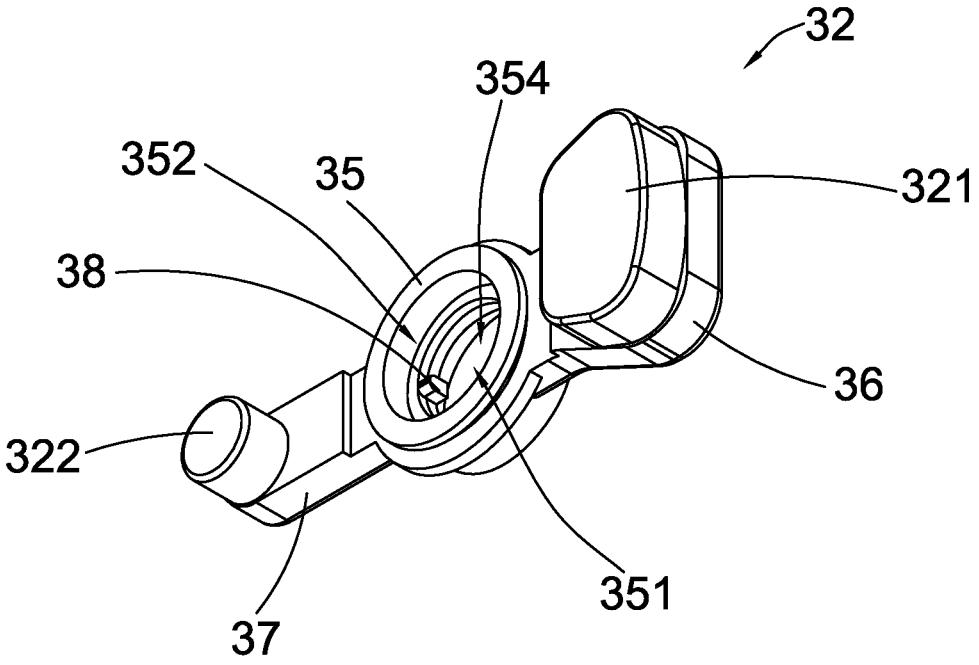
FIG. 7 is a perspective view of a sealing piece of the rotatable sealing arrangement according to the first preferred embodiment of the present invention.
Figure 8:
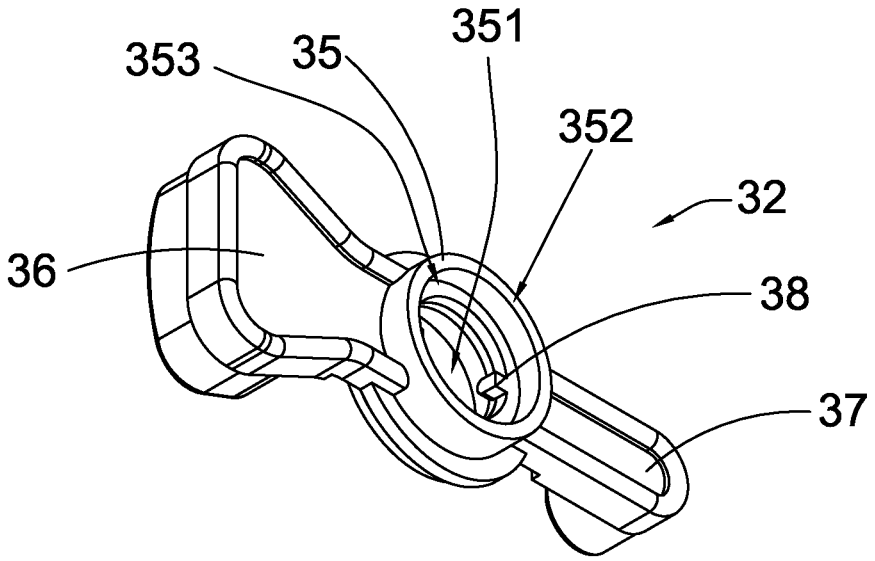
FIG. 8 is another perspective view of the sealing piece of the rotatable sealing arrangement according to the first preferred embodiment of the present invention.

The cover assembly 31 may be rotated on the lid body 21 to operatively move between an opened position and a closed position, wherein in the closed position, the cover assembly 31 is rotated so that the first sealing cover 34 is rotated to cover on top of the access opening 24, while the second sealing cover 36 of the sealing piece 32 is driven to move upwardly with respect to the main shaft 33 for blocking a bottom side of the access opening 24 so as to prevent liquid from the container cavity to spill out therefrom (see FIG. 1 and FIG. 5), wherein in the opened position, the first sealing cover 34 is rotated to expose the access opening 24 to ambient environment, while the second sealing cover 36 is driven to move downwardly with respect to the main shaft 33 so as to allow liquid to flow out of the container cavity 11 through the access opening 24 (see FIG. 2 and FIG. 6).

According to the first preferred embodiment of the present invention, the container body 10 may be configured from metallic or plastic material and may have a circular cross-sectional shape. The container body 10 may form a tubular structure in which the container cavity 11 may be formed therein. The container body 10 may further have a top opening 12 communicating the container cavity 11 with an exterior of the container body 10. The lid 20 may be selectively attached on the container body 10 at the top opening 12 to selectively close the container cavity 11.

Figure 3:
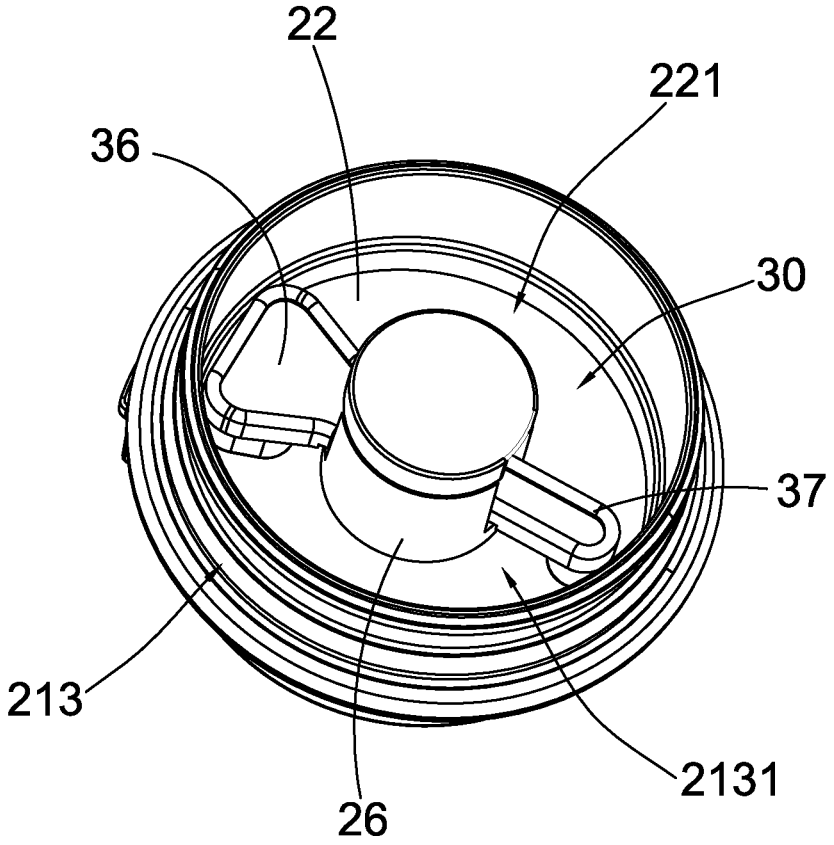
FIG. 3 is a bottom perspective view of a lid of the beverage container according to the first preferred embodiment of the present invention.
Figure 4:
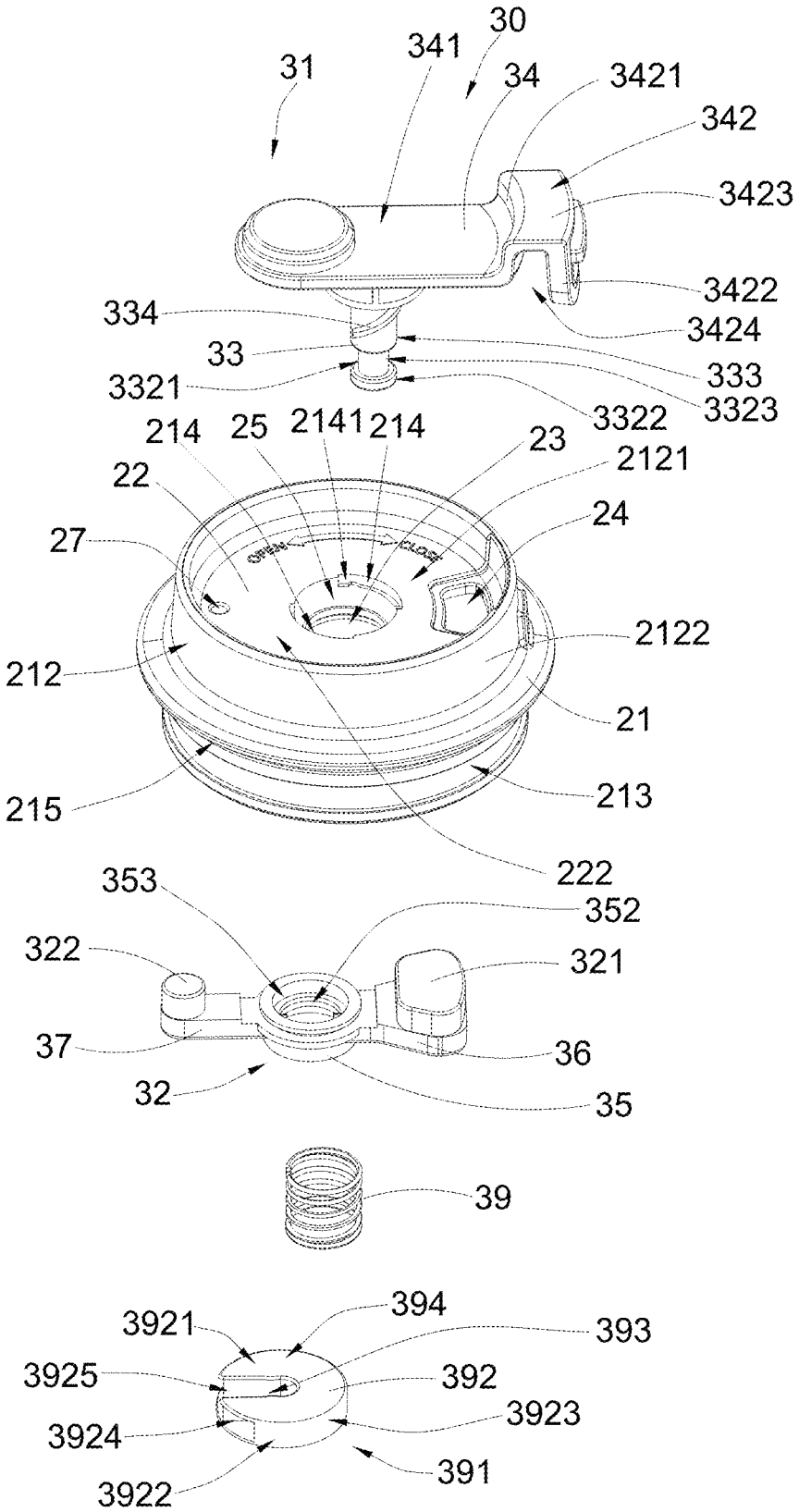
FIG. 4 is an exploded perspective view of the lid of the beverage container according to the first preferred embodiment of the present invention.

The lid 20 may mainly be configured from plastic material. The lid body 21 may have a cross sectional shape which is corresponding to that of the container body 10. As shown in FIG. 2 to FIG. 4 of the drawings, the lid body 21 may have an enlarged rim portion 211, an upper tubular portion 212 upwardly extended from the rim portion 211, and a lower tubular portion 213 downwardly extended from the rim portion 211. In this first preferred embodiment, the lid body 21 may have a circular cross-sectional shape which allows tight engagement with the container body 10. Other cross-sectional shapes for both the container body 10 and the lid body 21 are also possible.

Figure 12:
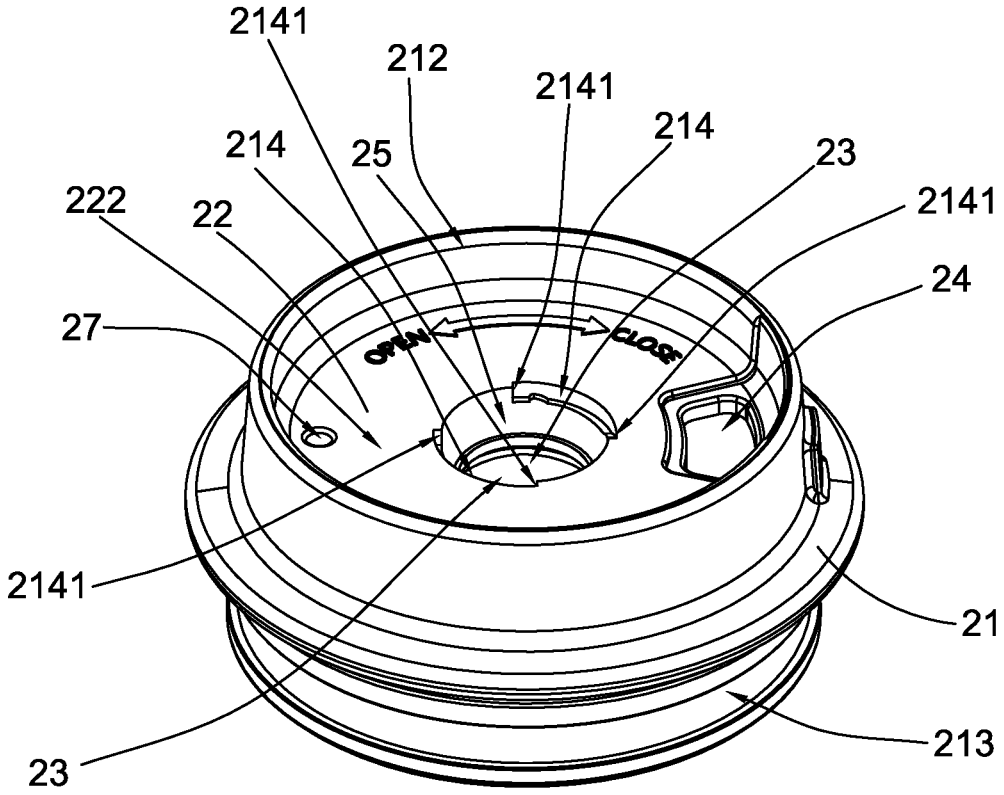
FIG. 12 is an enlarged perspective view of the lid of the beverage container according to the first preferred embodiment of the present invention.

As shown in FIG. 3, FIG. 4 and FIG. 12 of the drawings, each of the upper tubular portion 212 and the lower tubular portion 213 may define an upper cavity 2121 and a lower cavity 2131 respectively, wherein the top panel 22 may be formed in the upper cavity 2121. In other words, the upper tubular portion 212 constitutes a circumferential boundary of the upper cavity 2121, and the lower tubular portion 213 constitute a circumferential boundary of the lower cavity 2131.

The through central opening 23 may be surrounded by a sidewall 25 of the lid body 21. The lid body 21 may further has a plurality of securing grooves 214 indently formed on the sidewall 25. In this first preferred embodiment of the present invention, the through central opening 23 may have a circular cross section and the securing grooves 214 may be positioned on the sidewall 25 in such a manner that the securing grooves 214 may face each other. That is, they may be configured to be opposite to each other.

Since each of the securing grooves 214 is indently formed on the sidewall 25, therefore, each of the securing grooves 214 may form two biasing shoulders 2141 with the sidewall 25 at two ends of that corresponding securing groove 214.

Figure 11:
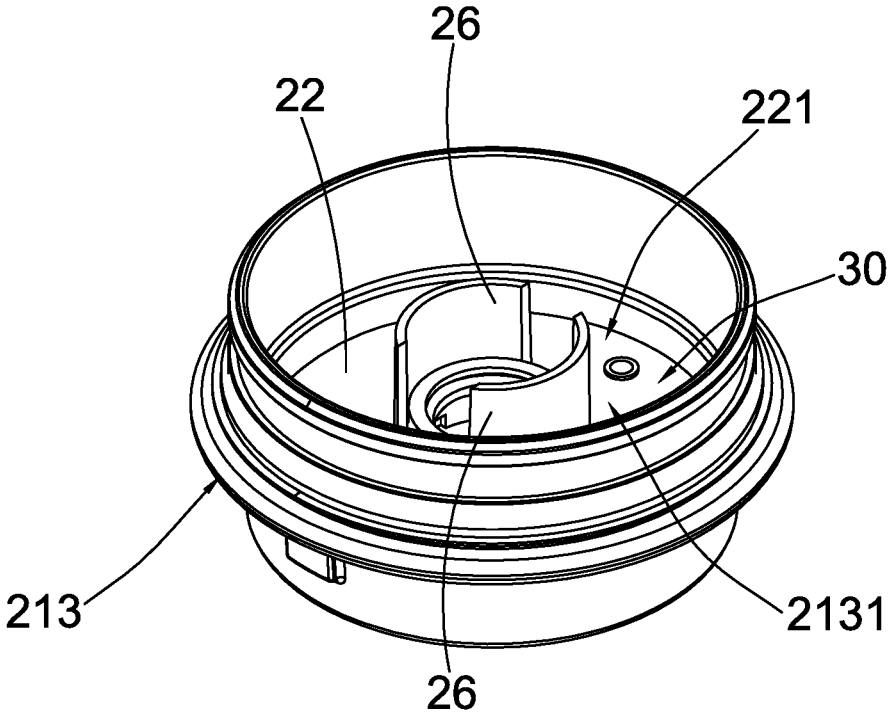
FIG. 11 is another bottom perspective view of the lid of the beverage container according to the first preferred embodiment of the present invention.

Moreover, the lid body 21 may further comprise a plurality of protective shields 26 downwardly extended from a bottom surface 221 of the top panel 22 in the lower cavity 2131, wherein the main shaft 33 and the coupler ring 35 may be received in the space surrounded by the protective shields 26. As shown in FIG. 3 and FIG. 11 of the drawings, each of the protective shields 26 may be configured as having a panel-like structure having a curved contour, wherein a radius of curvature may correspond to that of the through central opening 23.

The lid body 21 may further have a venting hole 27 formed on the top panel 22 at a position opposite to the access opening 24 for facilitating easy flowing of liquid through the access opening 24 when the cover assembly 31 is in the opened position.

The lid body 21 may further have a plurality of first engaging threads 215 formed on an external surface of the lower tubular portion 213 while the container body 11 may have a plurality of second engaging threads 15 formed on an inner surface surrounding the container cavity 11 near the top opening 12, wherein the first engaging threads 215 and the second engaging threads 15 may be positioned to correspond to each other so that the lid body 21 may engage with the container body 11 through detachable engagement between the first engaging threads 215 and the second engaging threads 15. An external diameter of the enlarged rim portion 211 may be larger than an internal diameter of the container cavity 11 so that when the lid body 21 is detachably attached on the container body 10, the top opening 12 may be fully covered by the lid body 21.

Figure 9:
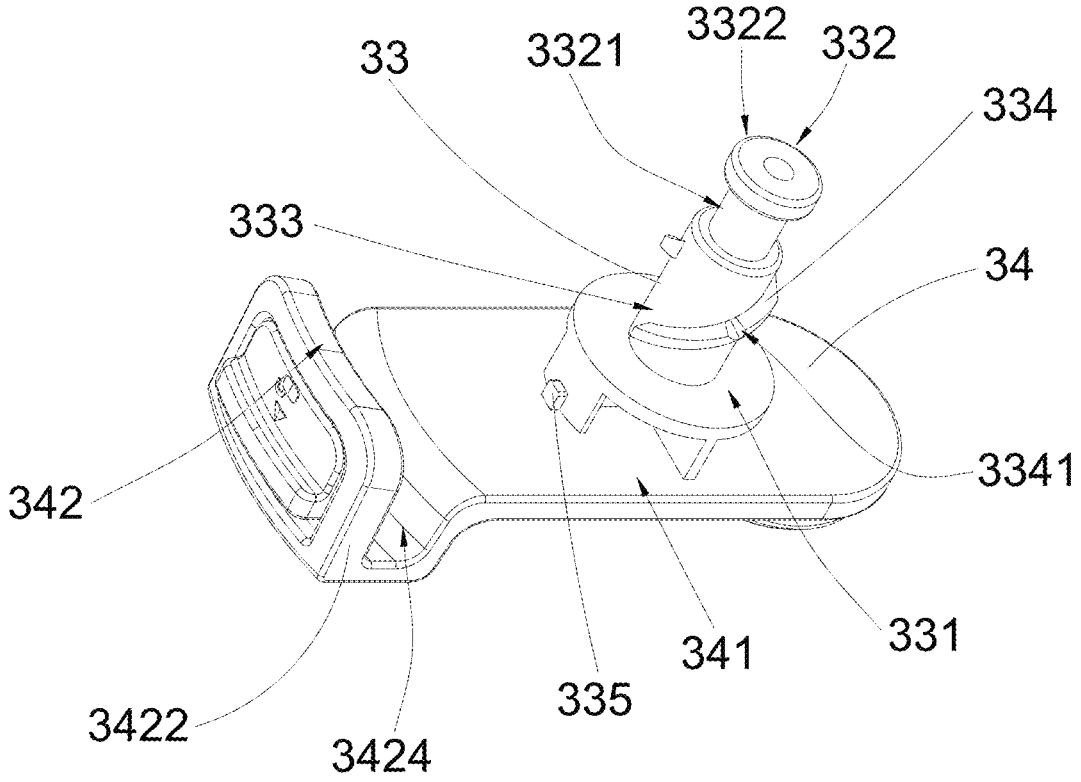
FIG. 9 is a bottom perspective view of a cover assembly of the rotatable sealing arrangement according to the first preferred embodiment of the present invention.
Figure 10:
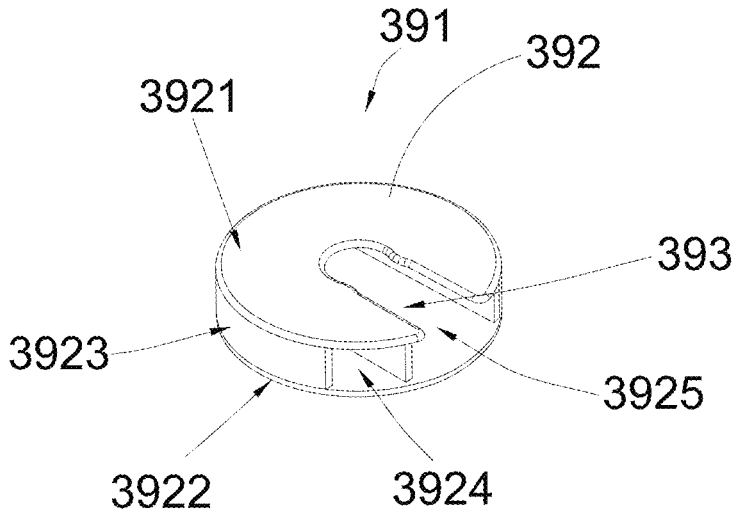
FIG. 10 is a perspective view of an end stopper of the rotatable sealing arrangement according to the first preferred embodiment of the present invention.

Referring to FIG. 4 and FIG. 9 of the drawings, the main shaft 33 of the cover assembly 31 may have an upper shaft portion 331, a lower shaft portion 332, and a middle shaft portion 333 extending between the upper shaft portion 331 and the lower shaft portion 332. The main shaft 33 as a whole may be arranged to be mounted in the lower cavity 2131 of the lower tubular portion 213 by penetrating through the through central opening 23.

The main shaft 33 may further comprise a plurality of (but at least one) guiding ridges 334 extending along the middle shaft portion 333 along a longitudinal direction thereof in a spiral configuration. Each of the guiding ridges 334 may have a locking indention 3341 formed thereon. The middle shaft portion 333 of the main shaft 33 may be configured to have an elongated and tubular structure.

According to the first preferred embodiment of the present invention, each of the upper shaft portion 331, the lower shaft portion 332 and the middle shaft portion 333 may have a circular cross sectional shape, wherein a diameter of the upper shaft portion 331 of the main shaft 33 may be larger than that of the middle shaft portion 333 while a vertical height of the upper shaft portion 331 may be smaller than that of the middle shaft portion 333.

On the other hand, the lower shaft portion 332 may be divided into a contracted section 3321 and a lower end section 3322, wherein a diameter of the contracted section 3321 may be smaller than that of the lower end section 3322 to form a circumferential slot 3323 at the lower shaft portion 332 due to change in diameter between the contracted section 3321 and the lower end section 3322.

The main shaft 33 may further comprise a plurality of securing protrusions 335 extended from the upper shaft portion 331 along a transverse direction of the main shaft 33. The securing protrusions 335 may be slidably received in the securing grooves 214 respectively. The securing protrusions 335 may also be connected to the first sealing cover 34 in such a manner that when the first sealing cover 34 is driven to rotate, the securing protrusions 335 may also be driven to rotate along the securing grooves 214 respectively. When the securing protrusion 335 hit the corresponding biasing shoulder 2141, further rotation of the first securing cover 34 with respect to the lid body 21 may be stopped. Hence, a length of the securing grooves 214 dictate the extent to which the first securing cover 34 may be rotated.

The first sealing cover 34 may transversely extend from the upper shaft portion 331 of the main shaft 33 and may be positioned on the top panel 22 of the lid body 21. In the first preferred embodiment of the present invention, the first sealing cover 34 may be positioned on a top surface 222 of the top panel 22.

Referring to FIG. 5 to FIG. 6 of the drawings, the first sealing cover 34 may have an elongated portion 341 and an engagement portion 342 constituted by a first wall 3421, a second wall 3422 and a third wall 3423 extending between the first wall 3421 and the second wall 3422. The engagement portion 342 may define an engagement slot 3424 as a space surrounded by the first wall 3421, the second wall 3422 and the third wall 3423. The engagement slot 3424 may engage with the upper tubular portion 212 of the lid body 21 such that a circumferential tubular wall 2122 of the upper tubular portion 212 may be received in the engagement slot 3424 in a slidably movable manner. A lock 50 may be provided to selectively lock the engagement portion 342 to the upper tubular portion 212.

In this first preferred embodiment of the present invention, the first wall 3421 may upwardly extend from one end of the elongated portion 341, while the second wall 3422 may transversely or sidewardly extend from the first wall 3421 to ride over the circumferential tubular wall 2122 of the upper tubular portion 212, while the third wall 3423 vertically extend from the second wall 3422. This configuration may be shown in FIG. 1 and FIG. 2 of the drawings.

Thus, the elongated portion 341 may be arranged to cover the access opening 24 and the venting hole 27 when the cover assembly 31 is in the closed position. On the other hand, the elongated portion 341 may be rotated to expose the access opening 24 and the venting hole 27 to ambient environment when the cover assembly 31 is in the opened position. From the above descriptions, one skilled in the art may appreciate that the first sealing cover 34 may seal or cover the access opening 24 and the venting hole 27 from a top side of the top panel 22 (i.e. from a top side of the access opening 24 and the venting hole 27).

The sealing piece 32 may be mounted underneath the top panel 22 to provide sealing to the container cavity 11 from underneath the top panel 22. The sealing piece 32 may further comprise a vent cover 37 outwardly extended from the coupler ring 35 in a direction opposite to the second sealing cover 36. In this first preferred embodiment of the present invention, the second sealing cover 36, the coupler ring 35 and the vent cover 37 may form an integral structure.

The sealing piece 32 may further comprise a plurality of traveling members 38 inwardly protruded from the boundary wall 352 of the coupler ring 35 and slidably engaged with the guiding ridge 334. The main shaft 33 of the rotatable sealing arrangement 30 may be arranged to penetrate the through hole 351 of the coupler ring 35 with the traveling members 38 slidably engaging with the corresponding guiding ridges 334 respectively. When the main shaft 33 is driven to rotate, the guiding ridges 334 are also driven to rotate, which force the traveling members 38 to travel along the corresponding guiding ridges 334 respectively. Note that the spiral orientation of the guiding ridges 334 is such that when cover assembly 31 is driven to rotate from the closed position to the opened position, the main shaft 33 may be driven to rotate such that the traveling members 38 may travel downwardly with respect to the main shaft 33 along the corresponding guiding ridges 334. As such, the sealing piece 32 may also travel downwardly with respect to the main shaft 33 and away from the top panel 22.

The sealing piece 32 may further comprises a first blocker member 321 and a second blocker member 322 extended from the second sealing cover 36 and the vent cover 37 respectively. The first blocker member 321 and the second blocker member 322 may be configured as protrusions respectively which may upwardly extend from the second sealing cover 36 and the vent cover 37 toward the access opening 24 and the venting hole 27 respectively for enhancing the sealing performance of the sealing piece 32.

As shown in FIG. 3 of the drawings, as an exemplary configuration, the vent cover 37 may have an elongated structure extending from the coupler ring 35, while a width of the second sealing cover 36 may gradually increase from the coupler ring 35 toward a far end thereof.

The rotatable sealing arrangement 30 may further comprise a resilient element 39 and an end stopper 391 mounted on the main shaft 33 for providing an upward urging force toward the coupler ring 35 so as to push the coupler ring 35 toward the top panel 22. Specifically, the resilient element 39 may be configured as a compression spring and may be mounted on the main shaft 33. On the other hand, the coupler ring 35 may further have a circumferential protrusion 353 circumferentially and inwardly extended from the boundary sidewall 352 so as to form a biasing platform 354 as a bottom surface of the circumferential protrusion 353. The resilient element 39 may bias against the biasing platform 353 when it is mounted on the main shaft 33. Thus, the sealing piece 32 may be subject to an upward urging force so as to seal the access opening 24 and the venting hole 27 from underneath the top panel 22.

On the other hand, the end stopper 391 may be mounted on the lower shaft portion 332 of the main shaft 33. As shown in FIG. 5 of the drawings, the end stopper 391 may comprise a stopper body 392 having an upper wall 3921, a lower wall 3922 and a peripheral wall 3923 extended between the upper wall 3921 and the lower wall 3922. The stopper body 392 may be configured to be a hollow structure so as to define a mounting cavity 3924 between the upper wall 3921, the lower wall 3922 and the peripheral wall 3923. In this first preferred embodiment, each of the upper wall 3921 and the lower wall 3922 may have a substantially circular cross section when viewed from the top.

Moreover, the upper wall 3921 may have a stopper slot 393 formed on the upper wall 3921. The stopper slot 393 may have an elongated structure and extend from a peripheral edge of the upper wall 3921 toward a center thereof. As a result, the upper wall 3921 may have a mounting opening 3925 formed as the opening of the stopper slot 393. As will be described below, the end stopper 391 may be arranged to couple to the main shaft 33. Thus, a width of the stopper slot 393 may be larger than a diameter of the contracted section 3321 of the lower shaft portion 332 but smaller than a diameter of the lower end section 3322.

As shown in FIG. 9 of the drawings, the end stopper 391 may be coupled to the lower shaft portion 332 of the main shaft 33 in such a manner that the contracted section 3321 of the lower shaft portion 332 may be slidably inserted into the stopper slot 393. Once the contracted section 3321 of the lower shaft portion 332 has been inserted into the stopper slot 393, an upward movement of the main shaft 33 will be limited by the upper wall 3921 of the end stopper 391. At the same time, the lower end section 3322 may be received in the mounting cavity 3924 in which a height of the lower end section 3322 is substantially identical to a vertical height of the mounting cavity 3924. Therefore, a downward vertical movement of the main shaft 33 may also be limited by the lower wall 3922 of the end stopper 391.

In other words, when the end stopper 391 is coupled to the lower shaft portion 332, a vertical movement of the main shaft 33 and the first sealing cover 34 may be securely retained and a relative vertical movement between the main shaft 33, the first sealing cover 34 and the lid body 21 may also be limited. The resilient element 39 may be positioned between the upper wall 3921 and the coupler ring 35, in such a manner that when the end stopper 391 is coupled to the main shaft 33, the resilient element 39 is arranged to exert an upward urging force toward the coupler ring 35 of the sealing piece 32. For example, the resilient element 39 may be a compression spring such that when the end stopper 391 is coupled to the main shaft 33, the resilient element 39 is slightly compressed and exert an upward urging force toward the sealing piece 32 so as to force the sealing piece 32 to seal the access opening 24 and the venting hole 27 from underneath the top panel 22.

The operation of the present invention may be described follows: when the cover assembly 31 is in the locked position, the first sealing cover 34 may be rotated such that the elongated portion 341 completely cover the access opening 24 and the venting hole 27 from the top of the top panel 22. At the same time, the sealing piece 32 may be pushed by the resilient element 39 so that the second sealing cover 36 and the vent cover 37 may be pushed to cover the access opening 24 and the venting hole 27 from underneath the top panel 22. This creates a double sealing effect (one from above the top panel 22 and one from underneath the top panel 22) to seal the access opening 24 and the venting hole 27. The result is that when the when the cover assembly 31 is in the locked position, liquid in the container cavity 11 is prevented from spilling out therefrom through the access opening 24 and the venting hole 27, even when the beverage container is flipped sideway or turned upside down.

When a user wishes to drink the liquid stored in the container cavity 11, he or she may rotate the first sealing cover 34 and the securing protrusions 335 may also be driven to rotate along the securing grooves 214 respectively. At the same time, the main shaft 33 may also be rotated and the traveling members 38 may travel along the guiding ridge 334 and cause the entire sealing piece 32 to move downwardly along the main shaft 33 so as to remove the blocking or sealing from underneath the access opening 24 and the venting hole 27. The traveling members 38 may continue traveling along the guiding ridges 334 until the traveling members 38 reach the locking indentions 3341 respectively. The locking indentions 3341 provide a weak retention force keep the traveling members 38 therein. The lengths of the securing grooves 214 may also be designed so that when the securing protrusions 335 reach the biasing shoulders 2141 respectively, the traveling members 38 are simultaneously received in the locking indentions 3341 respectively. At this time, the resilient element 39 as the compression spring is compressed. This has the effect of temporarily holding the first sealing cover 34 in position while the access opening 24 and the venting hole 27 are opened so that a user may drink the liquid stored in the container cavity 11 with ease and without needing to manually hole or retain the first sealing cover 34.

When the user finishes drinking the liquid, he or she may simply exert a slight force to the first sealing cover 34 in the direction which tend to close the access opening 24 and the venting hole 27. This slight force disengages the traveling members 38 from the locking indentions 3341. The upward pushing force exerted by the retention element 39 may cause the traveling members 38 to go back up along the guiding ridges 334 and this cause the entire sealing piece 32 to move upwardly along the main shaft 33 and back to its original position. At the same time, since the traveling members 38 are driven to move back up along the spiral guiding ridges 334, the first sealing cover 34 may be forced to rotate to move back to the original position so as to close the access opening 24 and the venting hole 27. At this time, the cover assembly 31 may be restored to the closed position.

One skilled in the art may appreciate that when the user has exerted the slight force to disengage the traveling members 38 from the locking indentions 3341, the cover assembly 31 (including the first sealing cover 34 and the sealing piece 32) will automatically restore to the closed position due to the effect of the retention element 39.

Referring to FIG. 13 to FIG. 25 of the drawings, a beverage container according to a second preferred embodiment of the present invention is illustrated.

According to the second preferred embodiment, the beverage container may comprise a container body 10', a lid 20', and a rotatable sealing arrangement 30'. The container body 10' may have a container cavity 11'. The beverage container may be used for storing a predetermined amount of liquid, such as water, and may be carried in a portable manner.

The lid 20' may comprise a lid body 21' detachably attached on the container body 10' to selectively enclose the container cavity 11', the lid body 21' may have a top panel 22', a through central opening 23', and an access opening 24' formed on the top panel 22' at a position apart from the through central opening 23'.

The rotatable sealing arrangement 30' may comprise a cover assembly 31' and a sealing piece 32'. The cover assembly 31' may comprise a main shaft 33' and a first sealing cover 34' transversely extended from the main shaft 33' and positioned on the top panel 22' of the lid body 21'.

The sealing piece 32' may be movably coupled to the main shaft 33' of the cover assembly 31'. The sealing piece 32' may comprise a coupler ring 35' having a through hole 351' formed therein, a second sealing cover 36' sidewardly extended from the coupler ring 35' to position underneath the first sealing cover 34' and the access opening 24'.

Figure 25:
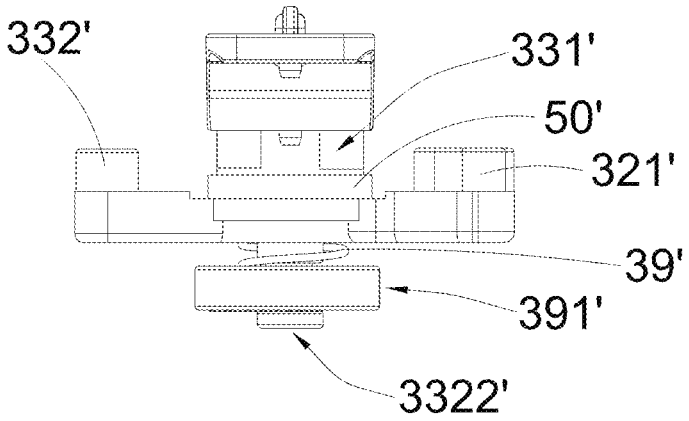
FIG. 25 is side schematic diagram of the rotatable sealing arrangement of the lid according to the second preferred embodiment of the present invention, illustrating that the lid body is in the opened position.

The cover assembly 31' may be rotated on the lid body 21' to operatively move between an opened position and a closed position, wherein in the closed position, the cover assembly 31' is rotated so that the first sealing cover 34' is rotated to cover on top of the access opening 24', while the second sealing cover 36' of the sealing piece 32' is driven to move upwardly with respect to the main shaft 33' for blocking a bottom side of the access opening 24' so as to prevent liquid from the container cavity to spill out therefrom (see FIG. 24), wherein in the opened position, the first sealing cover 34' is rotated to expose the access opening 24' to ambient environment, while the second sealing cover 36' is driven to move downwardly with respect to the main shaft 33' so as to allow liquid to flow out of the container cavity 11' through the access opening 24' (see FIG. 25).

According to the second preferred embodiment of the present invention, the container body 10' may be configured from metallic or plastic material and may have a circular cross-sectional shape. The container body 10' may form a tubular structure in which the container cavity 11' may be formed therein. The container body 10' may further have a top opening 12' communicating the container cavity 11' with an exterior of the container body 10'. The lid 20' may be selectively attached on the container body 10' at the top opening 12' to selectively close the container cavity 11'.

Figure 13:
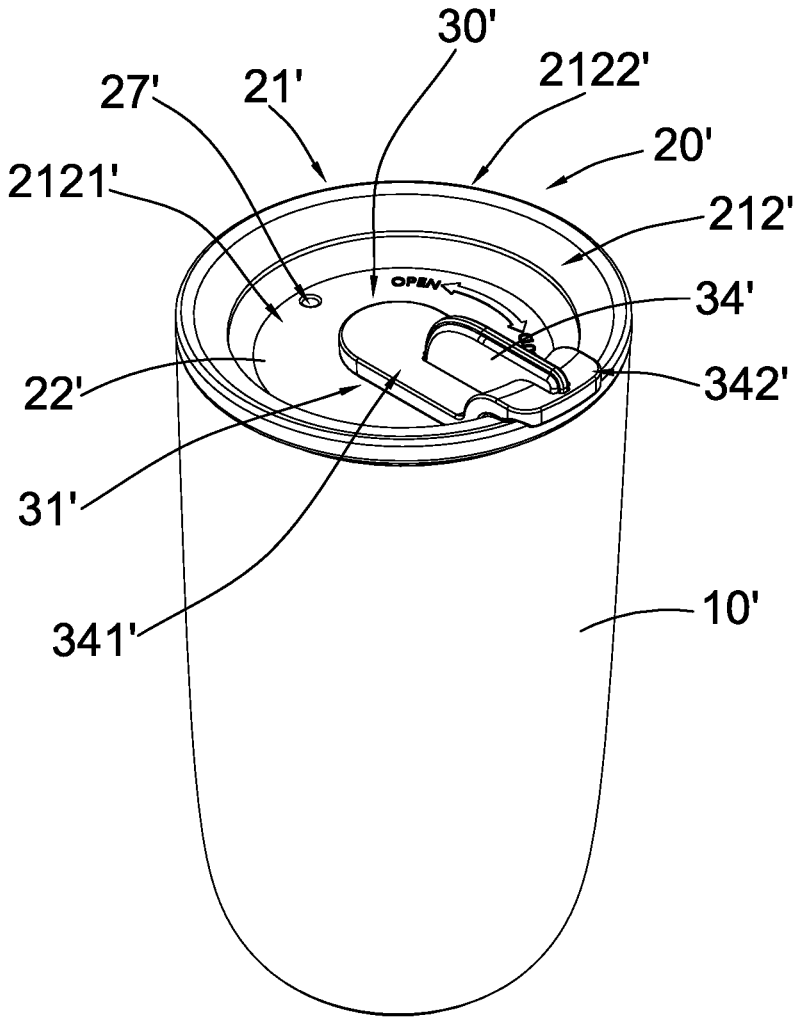
FIG. 13 is a perspective view of a beverage container according to a second preferred embodiment of the present invention.
Figure 14:
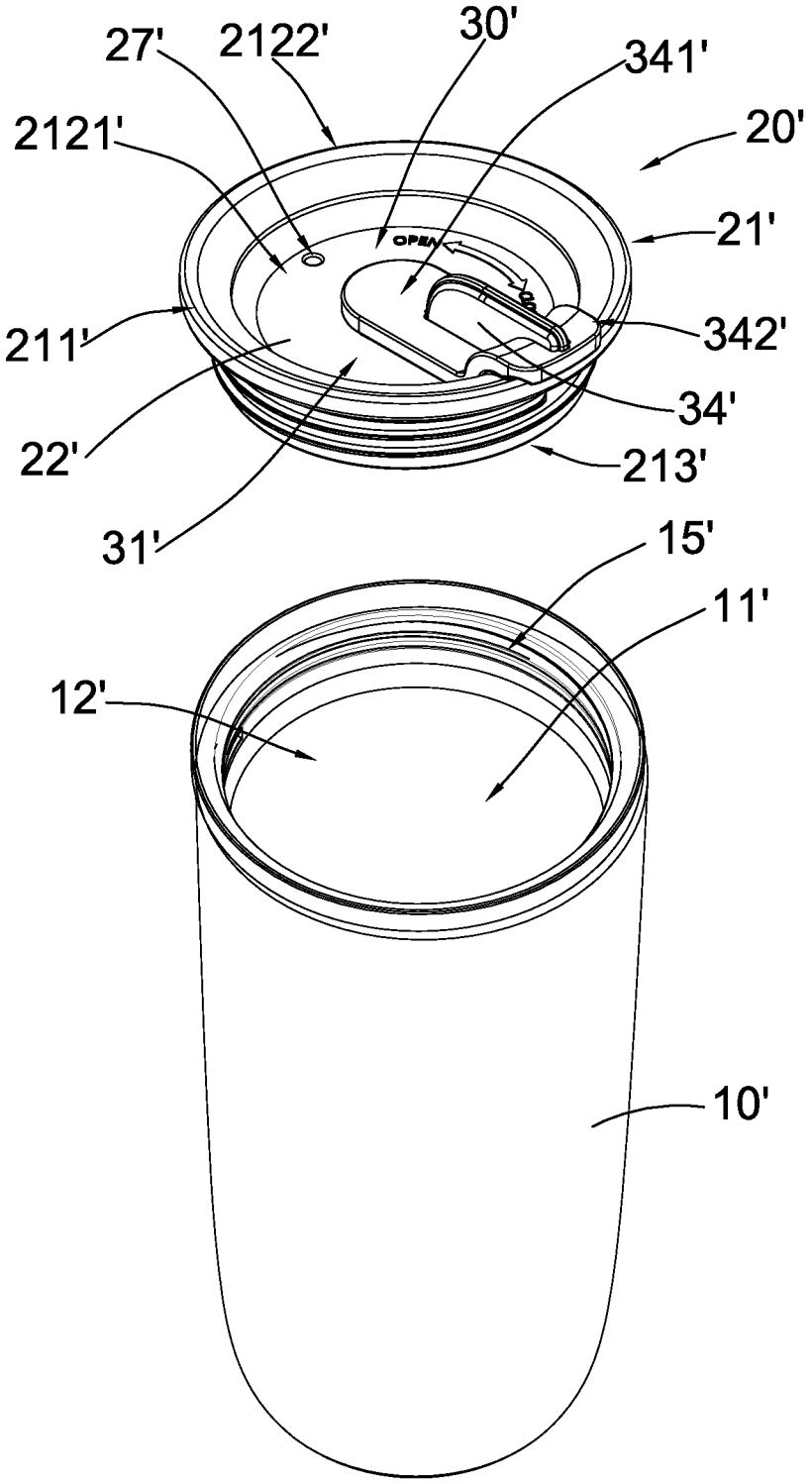
FIG. 14 is an exploded perspective view of the beverage container according to the second preferred embodiment of the present invention.

The lid 20' may mainly be configured from plastic material. The lid body 21' may have a cross sectional shape which is corresponding to that of the container body 10'. As shown in FIG. 13 to FIG. 14 of the drawings, the lid body 21' may have an enlarged rim portion 211', and a lower tubular portion 213' downwardly extended from the enlarged rim portion 211'. In this second preferred embodiment, the lid body 21' may have a circular cross-sectional shape which allows tight engagement with the container body 10'. Other cross-sectional shapes for both the container body 10' and the lid body 21' are also possible.

Figure 17:
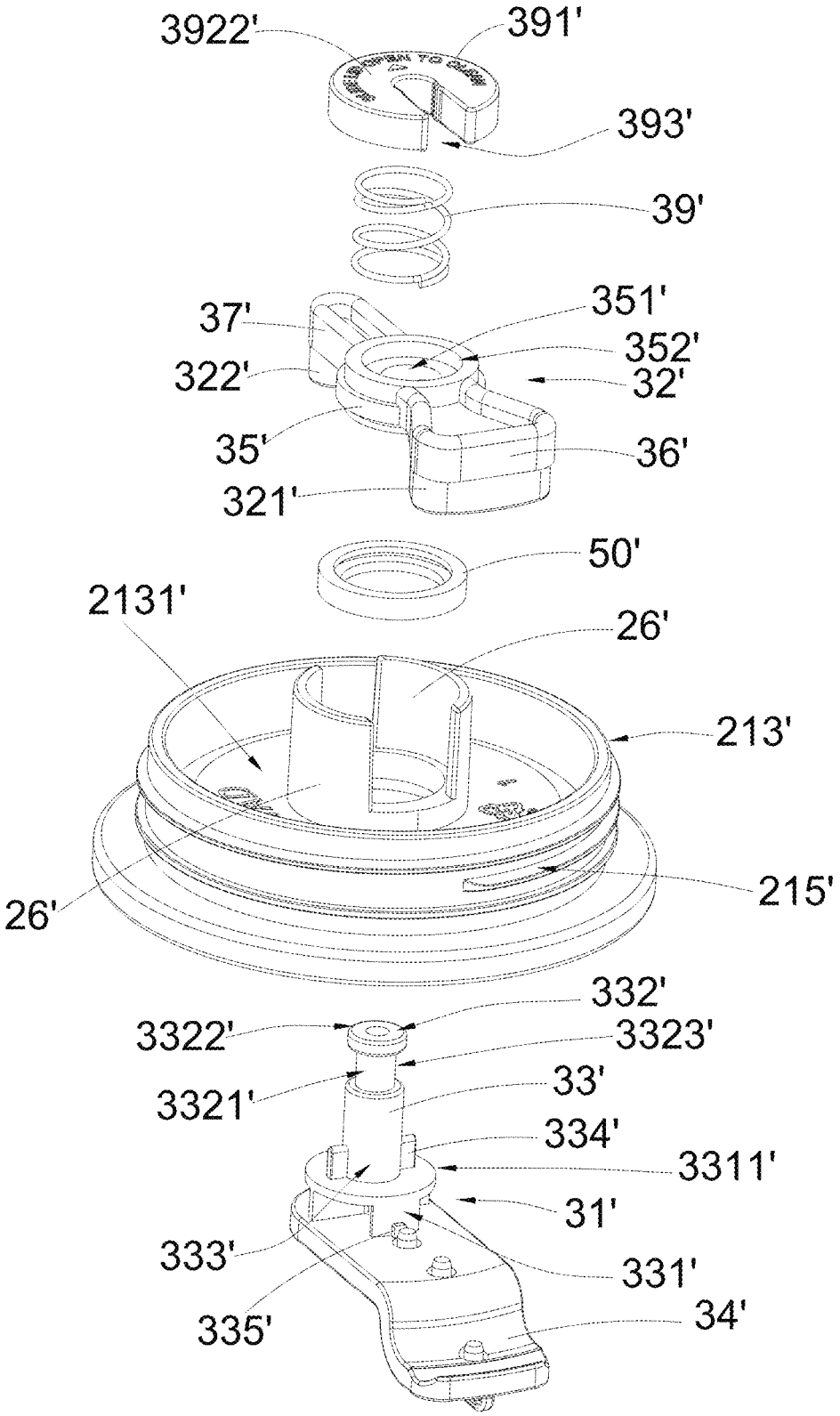
FIG. 17 is an exploded perspective view of the lid of the beverage container according to the second preferred embodiment of the present invention.

As shown in FIG. 17 of the drawings, the lower tubular portion 213' may define a lower cavity 2131'. The lid body 21' may further define an upper cavity 2121' on a top side of the lid body 21', wherein the top panel 22' may be formed in the upper cavity 2121'. The upper cavity 2121' may be circumferentially bounded by an inclined side boundary 212'. The lower tubular portion 213' may constitute a circumferential boundary of the lower cavity 2131'.

The through central opening 23' may be surrounded by a sidewall 25' of the lid body 21'. The lid body 21' may further has a plurality of securing grooves 214' indently formed on the sidewall 25'. In the second preferred embodiment of the present invention, the through central opening 23' may have a circular cross section and the securing grooves 214' may be positioned on the sidewall 25' in such a manner that the securing grooves 214' may face each other. That is, they may be configured to be opposite to each other.

Since each of the securing grooves 214' is indently formed on the sidewall 25', therefore, each of the securing grooves 214' may form two biasing shoulders 2141' with the sidewall 25' at two ends of that corresponding securing groove 214'.

Figure 18:
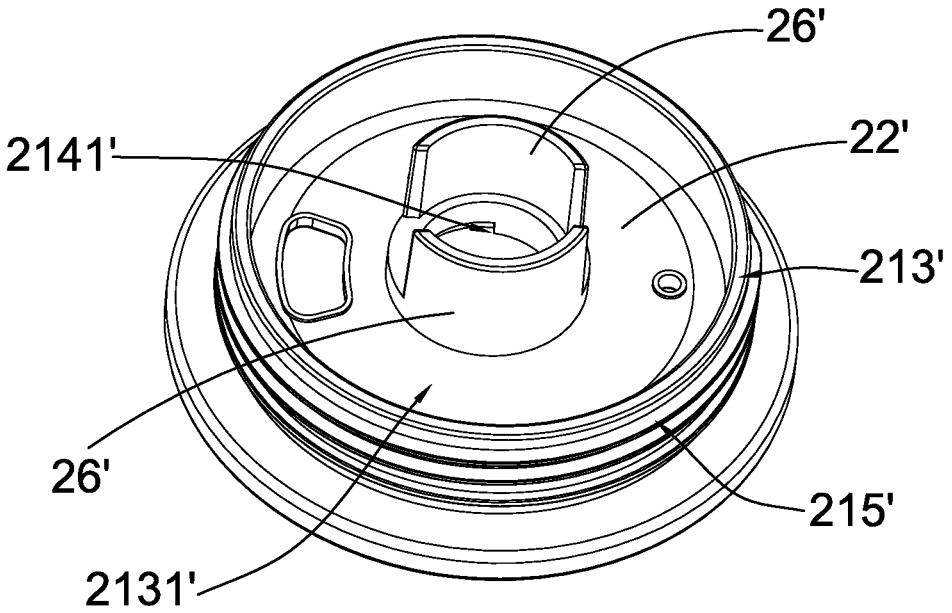
FIG. 18 is a bottom schematic diagram of the lid body of the beverage container according to the second preferred embodiment of the present invention.

Moreover, the lid body 21' may further comprise a plurality of protective shields 26' downwardly extended from a bottom surface 221' of the top panel 22' in the lower cavity 2131', wherein the main shaft 33' and the coupler ring 35' may be received in the space surrounded by the protective shields 26'. As shown in FIG. 17 and FIG. 18 of the drawings, each of the protective shields 26' may be configured as having a panel-like structure having a curved contour, wherein a radius of curvature may correspond to that of the through central opening 23'.

The lid body 21' may further have a plurality of first engaging threads 215' formed on an external surface of the lower tubular portion 213' while the container body 11' may have a plurality of second engaging threads 15' formed on an inner surface surrounding the container cavity 11' near the top opening 12', wherein the first engaging threads 215' and the second engaging threads 15' may be positioned to correspond to each other so that the lid body 21' may engage with the container body 11' through detachable engagement between the first engaging threads 215' and the second engaging threads 15'. An external diameter of the enlarged rim portion 211' may be larger than an internal diameter of the container cavity 11' so that when the lid body 21' is detachably attached on the container body 10', the top opening 12' may be fully covered by the lid body 21'.

The lid body 21' may further have a venting hole 27' formed on the top panel 22' at a position opposite to the access opening 24' for facilitating easy flowing of liquid through the access opening 24' when the cover assembly 31' is in the opened position.

Figure 19:
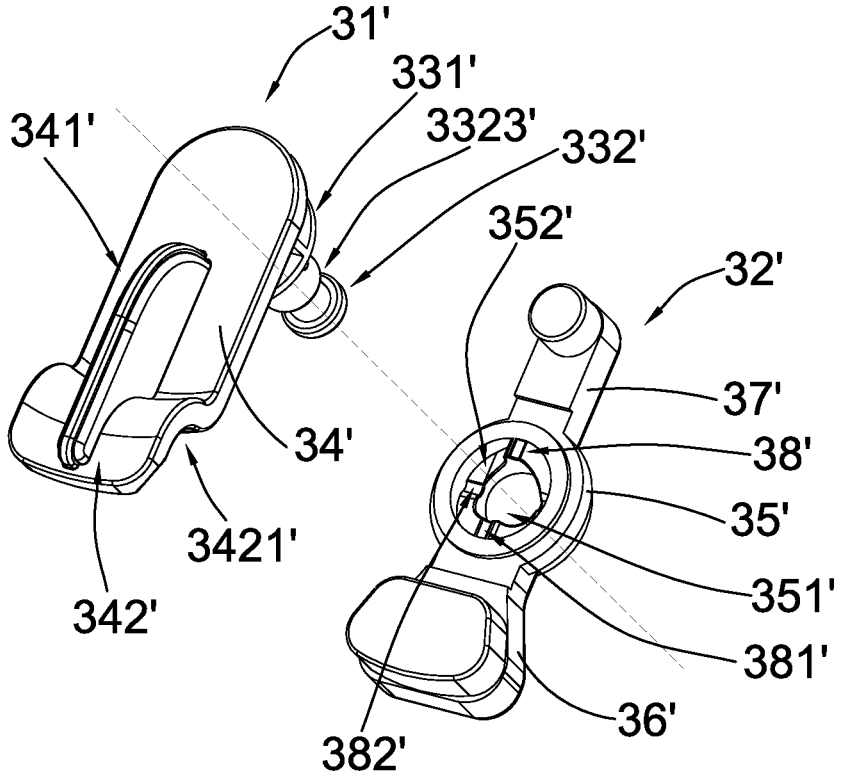
FIG. 19 is a schematic view of a cover assembly and a sealing piece of the lid according to the second preferred embodiment of the present invention.
Figure 20:
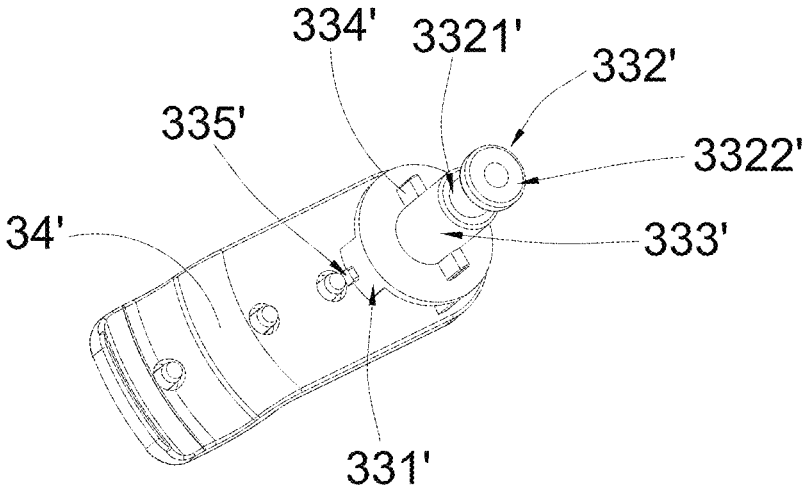
FIG. 20 is a bottom perspective view of the first sealing cover of the lid according to the second preferred embodiment of the present invention.

Referring to FIG. 17 and FIG. 19 of the drawings, the main shaft 33' of the cover assembly 31' may have an upper shaft portion 331', a lower shaft portion 332', and a middle shaft portion 333' extending between the upper shaft portion 331' and the lower shaft portion 332'. The main shaft 33' as a whole may be arranged to be mounted in the lower cavity 2131' of the lower tubular portion 213' by penetrating through the through central opening 23'.

As shown in FIG. 17 of the drawings, the main shaft 33' may further comprise a plurality of (but at least one) guiding ridges 334' transversely extending from the middle shaft portion 333'. Each of the guiding ridges 334' may oppositely extend with respect to the other guiding ridge 334'. The guiding ridges 334' may extend along a radial direction of the middle shaft portion 333'. Each of the guiding ridges 334' may have a rectangular structure in which each of the guiding ridges 334' may not extend beyond a peripheral edge 3311' of the upper shaft portion 331'. In this second preferred embodiment of the present invention, the middle shaft portion 333' of the main shaft 33' may be configured to have an elongated and tubular structure.

According to the second preferred embodiment of the present invention, each of the upper shaft portion 331', the lower shaft portion 332' and the middle shaft portion 333' may have a circular cross sectional shape, wherein a diameter of the upper shaft portion 331' of the main shaft 33' may be larger than that of the middle shaft portion 333' while a vertical height of the upper shaft portion 331' may be smaller than that of the middle shaft portion 333'.

On the other hand, the lower shaft portion 332' may be divided into a contracted section 3321' and a lower end section 3322', wherein a diameter of the contracted section 3321' may be smaller than that of the lower end section 3322' to form a circumferential slot 3323' at the lower shaft portion 332' due to change in diameter between the contracted section 3321' and the lower end section 3322'.

The main shaft 33' may further comprise a plurality of securing protrusions 335' extended from the upper shaft portion 331' along a transverse direction of the main shaft 33'. The securing protrusions 335' may be slidably received in the securing grooves 214' respectively. The securing protrusions 335' may also be connected to the first sealing cover 34' in such a manner that when the first sealing cover 34' is driven to rotate, the securing protrusions 335' may also be driven to rotate along the securing grooves 214' respectively. When the securing protrusion 335' hit the corresponding biasing shoulder 2141', further rotation of the first securing cover 34' with respect to the lid body 21' may be stopped. Hence, a length of the securing grooves 214' dictate the extent to which the first securing cover 34' may be rotated.

The first sealing cover 34' may transversely extend from the upper shaft portion 331' of the main shaft 33' and may be positioned on the top panel 22' of the lid body 21'. According to the second preferred embodiment of the present invention, the first sealing cover 34' may be positioned on a top surface 222' of the top panel 22', as shown in FIG. 13 of the drawings.

Referring to FIG. 13 and FIG. 19 of the drawings, the first sealing cover 34' may have an elongated portion 341' and an engagement portion 342' upwardly extending from the elongated portion 341'. The engagement portion 342' may upwardly extend from the elongated portion 341' to ride on the upper tubular portion 212' of the lid body 21' in such a manner that the engagement portion 342' may slide along the upper tubular portion 212' so as to facilitate rotation of the first sealing cover 34' on the lid body 21'.

Specifically, the first sealing cover 34' may further have an engaging slot 3421' formed on the engagement portion 342' for slidably engaging with a top edge 2122' of the upper tubular portion 212' of the lid body 21'. The engaging slot 3421' may have a curved contour so as to fit a curved contour of the top edge 2122' of the upper tubular portion 212' of the lid body 21'.

Thus, the elongated portion 341' may be arranged to cover the access opening 24' when the cover assembly 31' is in the closed position. On the other hand, the elongated portion 341' may be rotated to expose the access opening 24' to ambient environment when the cover assembly 31' is in the opened position. From the above descriptions, one skilled in the art may appreciate that the first sealing cover 34' may seal or cover the access opening 24' from a top side of the top panel 22' (i.e. from a top side of the access opening 24').

The sealing piece 32' may be mounted underneath the top panel 22' to provide sealing to the container cavity 11' from underneath the top panel 22'. The sealing piece 32' may further comprise a vent cover 37' outwardly extended from the coupler ring 35' in a direction opposite to the second sealing cover 36'. In this second preferred embodiment of the present invention, the second sealing cover 36', the coupler ring 35' and the vent cover 37' may form an integral structure.

As shown in FIG. 19 of the drawings, as an exemplary configuration, the vent cover 37' may have an elongated structure extending from the coupler ring 35', while a width of the second sealing cover 36' may gradually increase from the coupler ring 35' toward a far end thereof.

Figure 21:
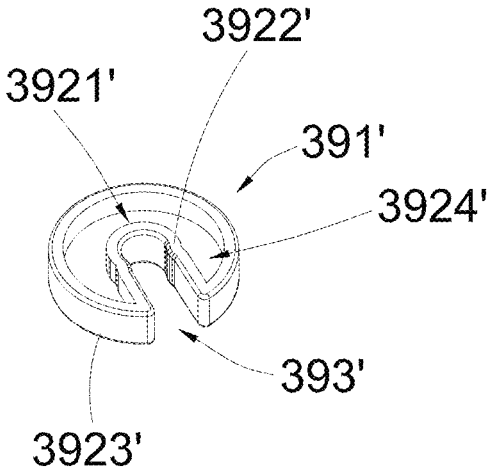
FIG. 21 is a perspective view of an end stopper of the lid according to the second preferred embodiment of the present invention.
Figure 22:
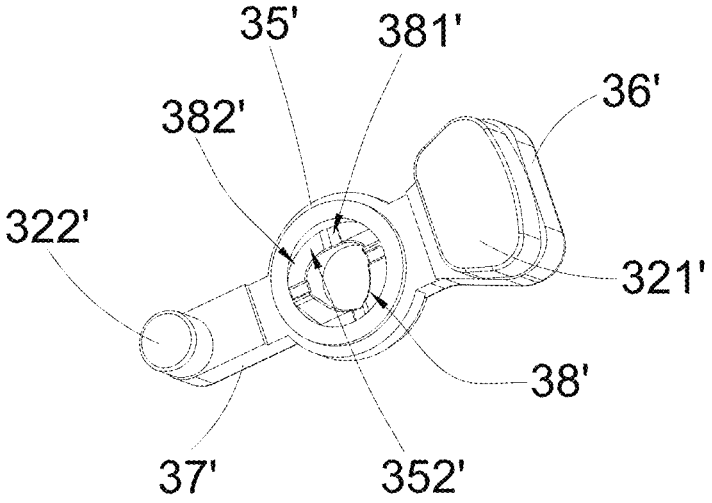
FIG. 22 is a top perspective view of the second sealing cover of the lid according to the second preferred embodiment of the present invention.

As shown in FIG. 19 and FIG. 21 to FIG. 22 of the drawings, the sealing piece 32' may further comprise a guiding rim 38' inwardly and peripherally extending from the boundary wall 352' of the coupler ring 35' and slidably engaged with the guiding ridges 334'. The main shaft 33' of the rotatable sealing arrangement 30' may be arranged to penetrate the through hole 351' of the coupler ring 35' with the guiding ridges 334' slidably engaging with the guiding rim 38'. As shown in FIG. 17 and FIG. 19 of the drawings, the guiding rim 38' may form a platform for slidably supporting the guiding ridges 334' traveling thereon. Specifically, the guiding rim 38' may have a plurality of indentions 381' spacedly formed thereon to divide the guiding rim 38' into a corresponding number of sections 382' between each two adjacent indentions 381'. Each of the indentions 381' may accommodate a corresponding guiding ridge 334' so as to provide a temporary locking effect to the main shaft 33'.

Moreover, each of the sections 382' of the guiding rim 38' may have an inclined contour so that when the main shaft 33' is rotated, the guiding ridges 334' may travel along the corresponding guiding rim 38' following the same inclined contour so as to move upwardly or downwardly with respect to the lid body 21'. When the main shaft 33' is driven to rotate, the guiding ridges 334' are also driven to rotate and travel along the corresponding sections 382' of the guiding rim 38'.

The rotatable sealing arrangement 30' may further comprise a resilient element 39' and an end stopper 391' mounted on the main shaft 33' for providing an upward urging force toward the coupler ring 35' so as to push the coupler ring 35' toward the top panel 22'. Specifically, the resilient element 39' may be configured as a compression spring and may be mounted on the main shaft 33'. The resilient element 39' may be arranged to bias against a bottom surface 383' of the guiding rim 38' when it is mounted on the main shaft 33'. Thus, the sealing piece 32' may be subject to an upward urging force so as to seal the access opening 24' from underneath the top panel 22'.

Figure 15:
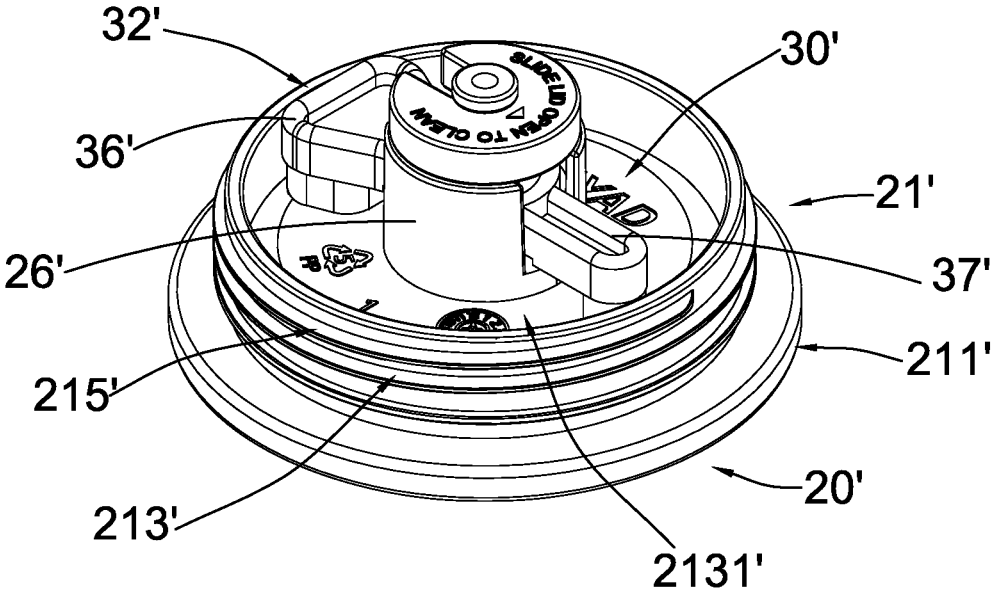
FIG. 15 is a bottom perspective view of a lid of the beverage container according to the second preferred embodiment of the present invention.
Figure 16:
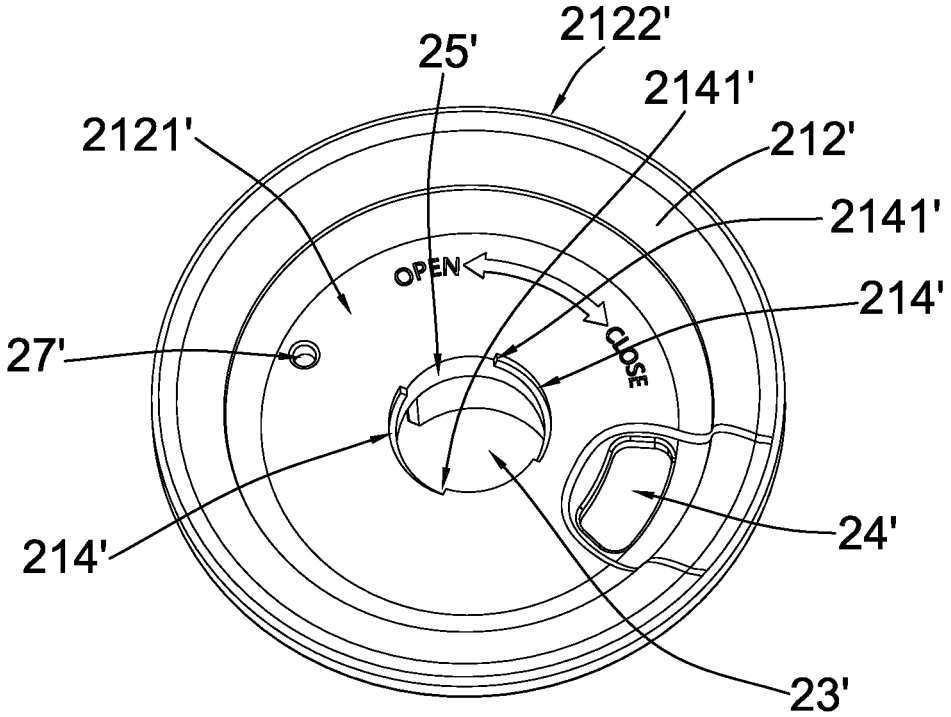
FIG. 16 is a perspective view of a lid body of the beverage container according to the second preferred embodiment of the present invention, illustrating that the lid body has a through central opening.

On the other hand, the end stopper 391' may be mounted on the lower shaft portion 332' of the main shaft 33'. As shown in FIG. 15 of the drawings, the end stopper 391' may comprise a stopper body 392' having a lower wall 3922' and a peripheral wall 3923'. The stopper body 392' may be configured to be a hollow structure so as to define a mounting cavity 3924' between the lower wall 3922' and the peripheral wall 3923'.

Moreover, the end stopper 392' may have a stopper slot 393' formed on the lower wall 3922'. The stopper slot 393' may have an elongated structure and extend from a peripheral edge of the lower wall 3922' toward a center thereof. As will be described below, the end stopper 391' may be arranged to couple to the main shaft 33'. Thus, a width of the stopper slot 393' may be larger than a diameter of the contracted section 3321' of the lower shaft portion 332' but smaller than a diameter of the lower end section 3322'.

Figure 23:
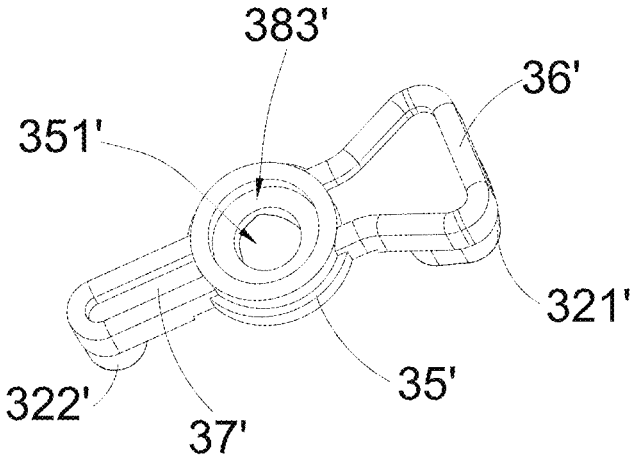
FIG. 23 is a bottom perspective view of the second sealing cover of the lid according to the second preferred embodiment of the present invention.
Figure 24:
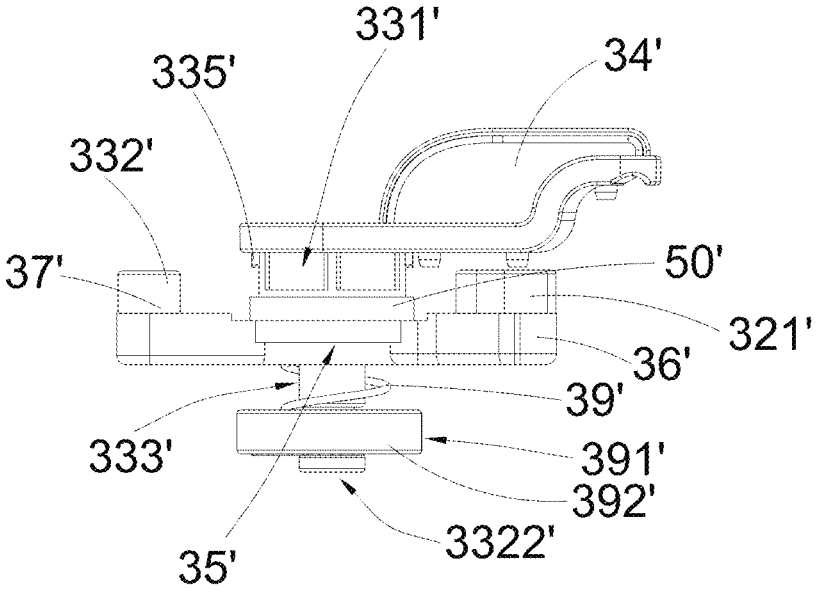
FIG. 24 is side schematic diagram of a rotatable sealing arrangement of the lid according to the second preferred embodiment of the present invention, illustrating that the lid body is in the closed position.

As shown in FIG. 23 of the drawings, the end stopper 391' may be coupled to the lower shaft portion 332' of the main shaft 33' in such a manner that the contracted section 3321' of the lower shaft portion 332' may be slidably inserted into the stopper slot 393'. Once the contracted section 3321' of the lower shaft portion 332' has been inserted into the stopper slot 393', an upward movement of the main shaft 33' may be limited by an upper rim edge 3921' of the peripheral wall 3923'. At the same time, the lower end section 3322' may be positioned underneath the end stopper 391' so that a downward vertical movement of the main shaft 33' may also be limited by the lower wall 3922' of the end stopper 391'.

In other words, when the end stopper 391' is coupled to the lower shaft portion 332', a vertical movement of the main shaft 33' and the first sealing cover 34' may be securely retained and a relative vertical movement between the main shaft 33', the first sealing cover 34' and the lid body 21' may also be limited. The resilient element 39' may be positioned between the end stopper 391' and the coupler ring 35', in such a manner that when the end stopper 391' is coupled to the main shaft 33', the resilient element 39' is arranged to exert an upward urging force toward the coupler ring 35' of the sealing piece 32'. For example, the resilient element 39' may be a compression spring such that when the end stopper 391' is coupled to the main shaft 33', the resilient element 39' is slightly compressed and exert an upward urging force toward the sealing piece 32' so as to force the sealing piece 32' to seal the access opening 24' and the venting hole 27' from underneath the top panel 22'.

When the guiding ridges 334' travel along the guiding rim 38', the main shaft 33' may tend to move upwardly or downwardly with respect to the lid body 21'. However, a downward vertical movement of the cover assembly 31' may be restricted by the lid body 21', while an upward vertical movement of the cover assembly 31' may also be restricted by the end stopper 391'.

The sealing piece 32' may further comprises a first blocker member 321' and a second blocker member 322' extended from the second sealing cover 36' and the vent cover 37' respectively. The first blocker member 321' and the second blocker member 322' may be configured as protrusions respectively which may upwardly extend from the second sealing cover 36' and the vent cover 37' toward the access opening 24' and the venting hole 27' respectively for enhancing the sealing performance of the sealing piece 32'.

The lid body 21' may further comprise a sealing ring 50' mounted in the space surrounded by the protective shields 26' above the coupler ring 35' for preventing liquid from undesirably leaking through the lid body 21', especially from the through central opening 23'. A diameter of the sealing ring 50' may be larger than that of the coupler ring 35'.

The operation of the present invention may be described as follows: when the cover assembly 31' is in the locked position, the first sealing cover 34' may be rotated such that the elongated portion 341' completely cover the access opening 24' and the venting hole 27' from the top of the top panel 22'. At the same time, the sealing piece 32' may be pushed by the resilient element 39' so that the second sealing cover 36' and the vent cover 37' may be pushed to cover the access opening 24' and the venting hole 27' from underneath the top panel 22'. This creates a double sealing effect (one from above the top panel 22' and one from underneath the top panel 22') to seal the access opening 24' and the venting hole 27'. The result is that when the when the cover assembly 31' is in the locked position, liquid in the container cavity 11' is prevented from spilling out therefrom through the access opening 24' and the venting hole 27', even when the beverage container is flipped sideway or turned upside down.

When a user wishes to drink the liquid stored in the container cavity 11', he or she may rotate the first sealing cover 34' and the securing protrusions 335' may also be driven to rotate along the securing grooves 214' respectively. At the same time, the main shaft 33' may also be rotated so that the guiding ridge 334' may travel along the guiding rim 38' and cause the entire sealing piece 32' to move downwardly along the main shaft 33' so as to remove the blocking or sealing from underneath the access opening 24' and the venting hole 27'. The guiding ridges 334' may continue traveling along the guiding rim 38' until the guiding ridges 334' reach a corresponding indention 381'.

The indentions 381' provide a weak retention force and keep the guiding ridges 334' therein. The lengths of the securing grooves 214' may also be designed so that when the securing protrusions 335' reach the biasing shoulders 2141' respectively, the guiding ridges 334' are simultaneously received in the indentions 381' respectively. At this time, the resilient element 39' as the compression spring is compressed. This has the effect of temporarily holding the first sealing cover 34' in position while the access opening 24' and the venting hole 27' are opened so that a user may drink the liquid stored in the container cavity 11' with ease and without needing to manually hole or retain the first sealing cover 34'.

When the user finishes drinking the liquid, he or she may simply exert a slight force to the first sealing cover 34' in the direction which tend to close the access opening 24' and the venting hole 27'. This slight force disengages the guiding ridges 334' from the indentions 381'. The upward pushing force exerted by the retention element 39' may cause the guiding ridges 334' to go back up along the guiding rim 38' and this cause the entire sealing piece 32' to move upwardly along the main shaft 33' and back to its original position. At the same time, since the guiding ridges 334' are driven to move back up along the inclined guiding rim 38', the first sealing cover 34' may be forced to rotate to move back to the original position so as to close the access opening 24' and the venting hole 27'. At this time, the cover assembly 31' may be restored to the closed position.

One skilled in the art may appreciate that when the user has exerted the slight force to disengage the guiding ridges 334' from the indentions 381', the cover assembly 31' (including the first sealing cover 34' and the sealing piece 32') will automatically restore to the closed position due to the effect of the retention element 39'.

The present invention, while illustrated and described in terms of a preferred embodiment and several alternatives, is not limited to the particular description contained in this specification. Additional alternative or equivalent components could also be used to practice the present invention.

What is claimed is:

1. A lid for a container body having a container cavity, comprising:

a lid body detachably attached on said container body to selectively enclose said container cavity, said lid body having a top panel, a through central opening, and an access opening formed on said top panel at a position apart from said through central opening, said main shaft of said cover assembly having an upper shaft portion, a lower shaft portion, and a middle shaft portion extending between said upper shaft portion and said lower shaft portion, said main shaft further comprising at least one guiding ridge transversely extending from said middle shaft portion; and a rotatable sealing arrangement, which comprises:

a cover assembly which comprises a main shaft and a first sealing cover transversely extended from said main shaft and positioned on said top panel of said lid body; and a sealing piece movably coupled to said main shaft of said cover assembly, said sealing piece comprising a coupler ring having a through hole formed therein, a second sealing cover sidewardly extended from said coupler ring to position underneath said first sealing cover and said access opening, said cover assembly being rotated on said lid body to operatively move between an opened position and a closed position, wherein in said closed position, said cover assembly is rotated so that said first sealing cover is rotated to cover on top of said access opening, while said second sealing cover of said sealing piece is driven to move upwardly with respect to said main shaft for blocking a bottom side of said access opening so as to prevent liquid from said container cavity from spilling out therefrom, wherein in said opened position, said first sealing cover is rotated to expose said access opening to an ambient environment, while said second sealing cover is driven to move downwardly with respect to said main shaft so as to allow liquid to flow out of said container cavity through said access opening; wherein said coupler ring has a boundary wall surrounding said through hole, said sealing piece further comprising a guiding rim inwardly and peripherally extending from said boundary wall of said coupler ring and slidably engaging with said guiding ridge, said main shaft being arranged to penetrate said through hole of said coupler ring with said guiding ridge slidably engaging with said guiding rim, said guiding rim having a plurality of indentions spacedly formed thereon to divide said guiding rim into a corresponding number of sections between two adjacent indentions, each of said indentions detachably accommodating said guiding ridge so as to provide a temporary locking effect to said main shaft, each of said sections of said guiding rim having an inclined contour so that when said main shaft is rotated, said guiding ridge is arranged to travel along said corresponding guiding rim following a corresponding identical inclined contour so as to move vertically with respect to said lid body.

2. The lid, as recited in claim 1, wherein each of said upper shaft portion, said lower shaft portion and said middle shaft portion has a circular cross-sectional shape, wherein a diameter of said upper shaft portion is larger than that of said middle shaft portion and said lower shaft portion.

3. The lid, as recited in claim 2, wherein said lower shaft portion is divided into a contracted section and a lower end section, wherein a diameter of said contracted section is smaller than that of said lower end section to form a circumferential slot at said lower shaft portion.

4. The lid, as recited in claim 3, wherein said rotatable sealing arrangement further comprises a resilient element and an end stopper mounted on said lower shaft portion of said main shaft for providing an upward urging force toward said coupler ring so as to push said coupler ring toward said top panel.

5. The lid, as recited in claim 4, wherein said end stopper has a stopper slot extending from a peripheral edge toward a center thereof, a width of said stopper slot being larger than a diameter of said contracted section of said lower shaft portion but smaller than a diameter of said lower end section, so that said end stopper is capable of detachably attaching on said contracted section of said lower shaft portion for limiting a vertical movement of said main shaft.

6. The lid, as recited in claim 5, wherein said lid body further comprises at least one protective shield downwardly extended from a bottom surface of said top panel, wherein said main shaft and said coupler ring are received in a space surrounded by said protective shield.

7. The lid, as recited in claim 6, wherein said lid body has an enlarged rim portion, and a lower tubular portion downwardly extended from said enlarged rim portion, said lower tubular portion forming a lower cavity.

8. The lid, as recited in claim 7, wherein said lid body further has at least one securing groove indently formed on a sidewall of said through central opening so as to form a biasing shoulder with said sidewall at two ends of said securing groove.

9. The lid, as recited in claim 8, wherein said main shaft further comprises at least one securing protrusion extending in a transverse direction away from said main shaft, said securing protrusion being slidably received in said securing groove, and connected to said first sealing cover in such a manner that when said first sealing cover is driven to rotate, said securing protrusion is also driven to rotate along said securing groove.

10. The lid, as recited in claim 9, wherein said lid body further has an upper tubular portion upwardly extending from said top panel, said first sealing cover having an elongated portion and an engagement portion upwardly extending from said elongated portion to ride on said upper tubular portion of said lid body in such a manner that said engagement portion is arranged to slide along said upper tubular portion so as to facilitate rotation of said first sealing cover on said lid body.

11. The lid, as recited in claim 1, wherein said lid body further comprises at least one protective shield downwardly extended from a bottom surface of said top panel, wherein said main shaft and said coupler ring are received in a space surrounded by said protective shield.

12. The lid, as recited in claim 11, wherein said lid body has an enlarged rim portion, and a lower tubular portion downwardly extended from said enlarged rim portion, said lower tubular portion forming a lower cavity.

13. The lid, as recited in claim 12, wherein said lid body further has at least one securing groove indently formed on a sidewall of said through central opening so as to form a biasing shoulder with said sidewall at two ends of said securing groove.

14. The lid, as recited in claim 13, wherein said main shaft further comprises at least one securing protrusion extending in a transverse direction away from said main shaft, said securing protrusion being slidably received in said securing groove, and connected to said first sealing cover in such a manner that when said first sealing cover is driven to rotate, said securing protrusion is also driven to rotate along said securing groove.

15. The lid, as recited in claim 14, wherein said lid body further has an upper tubular portion upwardly extending from said top panel, said first sealing cover having an elongated portion and an engagement portion upwardly extending from said elongated portion to ride on said upper tubular portion of said lid body in such a manner that said engagement portion is arranged to slide along said upper tubular portion so as to facilitate rotation of said first sealing cover on said lid body.

* * * * *